US011828164B2

(12) United States Patent
Hird et al.

(10) Patent No.: US 11,828,164 B2
(45) Date of Patent: Nov. 28, 2023

(54) INSTRUMENTED CUTTER

(71) Applicant: Schlumberger Technology Corporation, Sugar Land, TX (US)

(72) Inventors: Jonathan Robert Hird, Cambridge (GB); Michael Paul Barrett, Histon (GB); Tomas Rosinski, Cramlington (GB); Jarek Rosinski, Cramlington (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 222 days.

(21) Appl. No.: 17/598,334

(22) PCT Filed: Mar. 27, 2020

(86) PCT No.: PCT/US2020/025105
§ 371 (c)(1),
(2) Date: Sep. 27, 2021

(87) PCT Pub. No.: WO2020/205460
PCT Pub. Date: Oct. 8, 2020

(65) Prior Publication Data

US 2022/0178246 A1 Jun. 9, 2022

Related U.S. Application Data

(60) Provisional application No. 62/827,373, filed on Apr. 1, 2019, provisional application No. 62/827,516, filed
(Continued)

(51) Int. Cl.
*E21B 47/013* (2012.01)
*E21B 10/32* (2006.01)
(Continued)

(52) U.S. Cl.
CPC ..... *E21B 47/013* (2020.05); *E21B 10/32* (2013.01); *E21B 10/42* (2013.01); *E21B 10/567* (2013.01); *E21B 29/005* (2013.01)

(58) Field of Classification Search
CPC ..... E21B 47/013; E21B 47/01
See application file for complete search history.

(56) References Cited

U.S. PATENT DOCUMENTS 5,309,260 A 5/1994 Mizrahi et al.
5,956,442 A 9/1999 Byron
(Continued)

FOREIGN PATENT DOCUMENTS

GB 2535787 A 8/2016
WO 2015085288 A1 6/2015

OTHER PUBLICATIONS

International Search Report and Written Opinion in International Patent Application No. PCT/US2020/025105, dated Jul. 21, 2020, 10 pages.

*Primary Examiner* — Giovanna Wright
(74) *Attorney, Agent, or Firm* — Jeffrey D. Frantz

(57) ABSTRACT

A rotary cutting tool for use in a wellbore has an instrumented cutter fitted into a cavity in the tool body. The instrumented cutter body has an outer end portion exposed at the open end of a cavity and is connected to the tool body through at least one connecting section having a smaller cross-section and greater compliance than the outer end portion. The outer end portion and the connecting section are slightly movable within the cavity but the cavity surrounds at least part of the outer end portion sufficiently closely to limit transverse movement to elastic strain of the compliant connecting portion. One or more sensors, which may be strain gauges, are used to measure force on the outer end portion in a plurality of directions transverse to the cavity
(Continued)

and causing elastic strain of the at least one connecting section.

20 Claims, 14 Drawing Sheets

Related U.S. Application Data on Apr. 1, 2019, provisional application No. 62/827,549, filed on Apr. 1, 2019.

(51) Int. Cl.

| | |
|---|---|
| ***E21B 10/42*** | (2006.01) |
| *E21B 10/567* | (2006.01) |
| *E21B 29/00* | (2006.01) |

(56) References Cited

U.S. PATENT DOCUMENTS

| | | | | |
|---|---|---|---|---|
| 8,028,764 | B2 | 10/2011 | Teodorescu | |
| 8,211,203 | B2 | 7/2012 | Sheng et al. | |
| 8,757,290 | B2 | 6/2014 | Teodorescu et al. | |
| 9,045,972 | B2 | 6/2015 | Cheng | |
| 9,739,093 | B2 | 8/2017 | Trinh et al. | |
| 9,920,624 | B2 | 3/2018 | Doheny, II et al. | |
| 10,047,566 | B2 | 8/2018 | Vaughn et al. | |
| 10,072,492 | B2 | 9/2018 | Digiovanni | |
| 10,233,698 | B2 | 3/2019 | Humphrey et al. | |
| 10,570,670 | B2 | 2/2020 | Bird et al. | |
| 10,584,581 | B2 | 3/2020 | Cao et al. | |
| 10,655,401 | B2 | 5/2020 | Azar et al. | |
| 10,662,769 | B2 | 5/2020 | Kumar et al. | |
| 10,689,977 | B2 | 6/2020 | Scott et al. | |
| 10,890,683 | B2 | 1/2021 | Leuenberger et al. | |
| 10,927,609 | B2 | 2/2021 | Difoggio | |
| 11,030,735 | B2 | 6/2021 | Spivey et al. | |
| 11,111,731 | B2 | 9/2021 | Cao et al. | |
| 2002/0096362 | A1* | 7/2002 | Rankin | E21B 7/28 175/45 |
| 2006/0065395 | A1* | 3/2006 | Snell | E21B 47/01 175/45 |
| 2009/0194332 | A1* | 8/2009 | Pastusek | E21B 47/00 702/9 |
| 2010/0139987 | A1 | 6/2010 | Hunt et al. | |
| 2010/0270087 | A1* | 10/2010 | Marvel | E21B 10/43 175/426 |
| 2012/0000707 | A1 | 1/2012 | Hall et al. | |
| 2012/0132468 | A1 | 5/2012 | Scott et al. | |
| 2012/0312599 | A1 | 12/2012 | Trinh et al. | |
| 2013/0270890 | A1 | 10/2013 | Hall | |
| 2016/0010395 | A1 | 1/2016 | Trinh et al. | |
| 2017/0204674 | A1 | 7/2017 | Russell et al. | |
| 2017/0284161 | A1 | 10/2017 | Zhang | |
| 2018/0171772 | A1 | 6/2018 | Rodney | |
| 2020/0011171 | A1 | 1/2020 | Cao et al. | |
| 2020/0095831 | A1 | 3/2020 | Etebu et al. | |
| 2020/0141111 | A1 | 5/2020 | Kelly et al. | |
| 2020/0239796 | A1 | 7/2020 | Lee | |
| 2020/0239799 | A1 | 7/2020 | Hiraiwa et al. | |
| 2020/0239800 | A1 | 7/2020 | Hiraiwa et al. | |
| 2020/0308954 | A1 | 10/2020 | Hird et al. | |
| 2020/0308955 | A1 | 10/2020 | Hird et al. | |
| 2021/0089562 | A1 | 3/2021 | Rappa et al. | |
| 2021/0089564 | A1 | 3/2021 | Vuskovic et al. | |
| 2021/0136776 | A1 | 5/2021 | Schierl et al. | |

* cited by examiner

INSTRUMENTED CUTTER

CROSS-REFERENCE TO RELATED APPLICATIONS

This application is the U.S. national phase of International Patent Application No. PCT/US2020/025105, filed Mar. 27, 2020, which claims the benefit of, and priority to, U.S. Patent Application No. 62/827,549, filed Apr. 1, 2019, U.S. Patent Application No. 62/827,516 filed Apr. 1, 2019, and to U.S. Patent Application No. 62/827,373, filed Apr. 1, 2019. Each of the foregoing is expressly incorporated herein by this reference in its entirety.

BACKGROUND

Reamers and drill bits have commonly been constructed with a cutting structure that includes blocks or blades that define a plurality of cavities, sometimes referred to as pockets, into which cutters are fitted. This tool body can be incorporated into a drill string or attached to a downhole motor to rotate the tool.

Example cutters used in a drill bit or reamer are include polycrystalline diamond (PDC) cutters which include a polycrystalline diamond cutting face bonded to a substrate made of tungsten carbide. The polycrystalline diamond cutting face is made of particles of diamond sintered integrally with the substrate using a binder. Cutters for a milling tool intended to remove metal from the interior of metal tubing may be attached to pockets of a milling blade, or bonded directly to a face of the blade, and can be made from sintered tungsten carbide.

Cutters of drill bits, reamers, and mills can be secured in the pockets using brazing techniques that attach the cutters within a respective pocket or to a face of the cutting tool.

SUMMARY

This summary is provided to introduce a selection of concepts that are further described below in the detailed description. This summary is not intended to be used as an aid in limiting the scope of the claimed subject matter.

Embodiments of the present disclosure relate to a rotary cutting tool for creating or enlarging an underground conduit comprising a tool body which defines a plurality of cavities each with an open end and a plurality of cutters fitted into the cavities and attached to the tool body.

The cutting tool has at least one cutter with a cutter body which comprises an outer end portion which is exposed at the open end of a cavity and is connected within the cavity to the tool body through at least one connecting section which is rigidly connected to the outer end portion but has smaller cross-section than the outer end portion so as to have greater compliance than the outer end portion. The total cross-sectional area of the connecting section or sections, transverse to the connection, may be less than the cross-sectional area of the outer end portion. The tool comprises at least one sensor so as to be able to measure force(s) acting on the outer end portion of the cutter in any of a plurality of directions transverse to the cavity and the cutter therein.

This cutter body may also comprise an inner end portion fixed, within the cavity, to the tool body, with the at least one connecting section extending between and rigidly connected to the inner and outer end portions, and the at least one connecting section being of smaller cross-sectional area than both the inner and outer end portions so as to have greater compliance than the inner and outer end portions. With such a construction, the outer end portion and the connecting section are not attached directly to the tool body but are attached through the inner end portion which is fixed to the tool body. The inner and outer portions of the cutter body are both rigidly connected to the connecting section(s) so that forces acting on the outer end portion can be transmitted to the connecting section(s) and also transmitted from there to the inner end portion and onwards to the tool body. When force is applied to the hard face of the cutter, which is on the outer end portion, it causes strain. This strain consists mostly of distortion of the connecting section(s) because this or each of these has smaller cross-sectional area than the outer end portion and so is more compliant.

The cavity wall may surround at least part of the outer end portion closely, but with a small spacing sufficient to allow limited movement of the outer end portion transversely to the cavity. This can then cause strain of the connecting section. However, the cavity wall may be close enough to the outer end portion of the cutter that the limited range of movement of the outer end portion cannot cause more than elastic deformation of the connecting section(s), that is to say it cannot cause deformation which exceeds the elastic limit.

Spacing between the connecting section(s) and the surrounding cavity wall may be greater than spacing between the outer end portion and cavity wall. This may ensure that force transmitted to the connecting section(s) comes exclusively from the outer end portion because the tool body cannot directly contact the connecting section(s) and transmit force to them.

The connecting section(s) may be a plurality of individual connecting sections which are spaced apart and have a total cross-sectional area less than the cross-sectional area of the outer end portion and any inner end portion. As an alternative to this construction, there may be only a single connecting section which may be a single hollow cylinder.

The provision of more compliant connecting section(s) allows force(s) on the hard face of the cutter to cause a distortion of the cutter body and such distortion may enable measurement of force(s) acting on the cutter body. There are a number of possibilities for sensor(s) to measure forces. A position sensor may be used to observe change in position of the outer portion relative to the tool body, possibly by measuring change in position of the outer portion relative to an inner end portion. Another approach is to measure strain (which is of course distortion) of the connecting section(s). This may be done with strain sensors attached to the connecting section(s).

In a second aspect the present disclosure provides a rotary cutting tool for creating or enlarging an underground conduit comprising a tool body which defines a plurality of cavities each with an open end and a plurality of cutters fitted into the cavities and attached to the tool body, wherein: at least one cutter fitted into a said cavity has a cutter body which comprises an outer end portion which is exposed at the open end of a cavity and is connected within the cavity to the tool body through at least one connecting section which is rigidly connected to the outer end portion but has smaller cross-section than the outer end portion so as to have greater compliance than the outer end portion; the at least one connecting section and the surrounding cavity of the tool body are dimensioned so that the spacing between the at least one connecting section and the wall of the cavity is greater than the spacing between the outer end portion and the wall of the cavity; and the tool comprises at least one sensor to measure forces acting on the outer end portion in a plurality of directions.

The total cross-sectional area of the connecting section(s) transverse to an axis of the cutter may be not more than 50 percent of the cross-sectional area of the outer end portion transverse to the same axis. It may lie in a range from 15 or 20% up to 40% of the cross-sectional area of the outer end portion.

A third aspect of this disclosure provides a rotary cutting tool for creating or enlarging an underground conduit comprising a tool body which defines a plurality of cavities and a plurality of cutters fitted into the cavities and attached to the tool body, wherein: at least one cutter fitted into a said cavity has a cutter body which comprises an outer end portion which is exposed at the open end of a cavity and is connected within the cavity to the tool body through at least one connecting section which is rigidly connected to the outer end portion but has smaller cross-section than the outer end portion so as to have greater compliance than the outer end portion; and the at least one connecting section has cross-sectional area which is no more than 50% of the cross sectional area of the outer end portion so as to have greater compliance than the outer end portion, and the tool comprises at least one sensor to measure forces acting on the outer end portion in a plurality of directions.

As already mentioned, the cutter body may also comprise an inner end portion fixed, within the cavity, to the tool body, with the at least one connecting section extending between and rigidly connected to the inner and outer end portions, and the at least one connecting section being of smaller cross-sectional area than both the inner and outer end portions so as to have greater compliance than the inner and outer end portions.

An inner end portion of the cutter body may have a shape other than cylindrical, engage a matching shape of the cavity and thereby constrain the cutter body against rotation relative to the tool body.

A cutter may have a hard cutting face which is exposed at the open end of a cavity. Such a hard face may be harder than steel and may have a Knoop hardness of at least 1300, 1600, 1800 or even more. Tungsten carbide is a well known hard material which has good thermal stability. Other hard carbides are the carbides of other transition metals, such as vanadium, chromium, titanium, tantalum and niobium. Silicon, boron and aluminium carbides are also hard carbides. Further hard materials are boron nitride and aluminium boride. These hard materials may be used to provide a hard face on the outer end portion of a body, in particular if the cutter is to be used in a tool for milling tubing. For drill bits and reamers the outer end portion of a cutter may have a hard polycrystalline diamond face which will provide the greatly superior hardness of diamond.

A sensor may measure strain of the connecting section(s) and embodiments of the present disclosure include strain sensors attached to the connecting section(s). A strain sensor may be an electrical resistance strain gauge and may comprise an electrically conductive track on an electrically insulating carrier adhered to the connecting section (or one of a plurality of connecting sections) so that strain of the connecting section changes the length and electrical resistance of the conductive track. Multiple strain gauges may be configured and electrically connected to measure one component of force separately from another. The strain gauges on the connecting section or sections may be configured and connected to measure strain from components of force exerting shear on the outer end portion of the cutter body in each of two directions perpendicular each other and also perpendicular to the axis of the body and the cavity. The strain gauges may also be configured and connected to measure strain resulting from axial load on the outer end of the cutter body.

In a further aspect there is now disclosed a method of observing forces on a cutter of a rotary cutting tool comprising providing a rotary cutting tool as any stated above with one or more cutters as stated above and observing or recording data from the sensor or sensors thereof while operating the tool within a conduit.

DETAILED DESCRIPTION

Example embodiments of the present disclosure relate to providing instrumentation in a rotary cutting tool used to create, extend, or enlarge an underground conduit. This conduit may be a wellbore drilled through geological formations, and the tool may be a drill bit or reamer whose purpose is to create, extend, or widen a borehole. The tool may also include a mill used to remove material from casing or other tubing within a conduit. In Patent Publication No. GB2535787A, which is incorporated herein by this reference in its entirety, an example milling tool is disclosed for removing metal from the interior of tubing within a borehole, where the tool also has a body which defines cavities to receive hard faced cutters.

Figure 1:
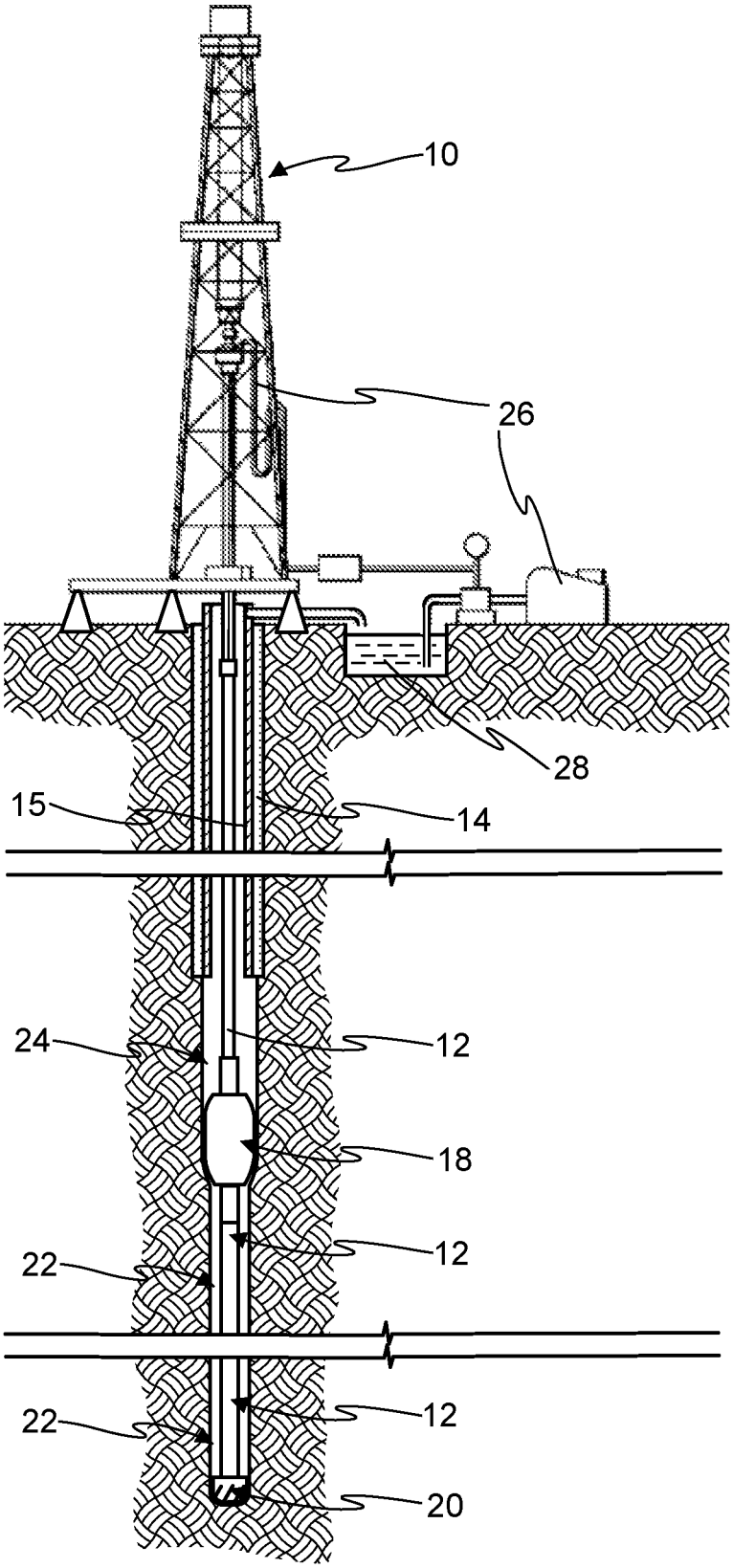
FIG. 1 is a schematic, cross-sectional view of a drilling assembly in a borehole.

FIG. 1 shows by way of example a drilling assembly that includes both a drill bit 20 and a cutting tool 18 that may include an underreamer or milling tool. A drill string 12 extends from a drilling rig 10 into a borehole. An upper part of the borehole has been lined with casing 15 and cemented as indicated at 14. The drill string 12 is connected to the cutting tool 18 which is connected by more of the drill string 12 to a drill bit 20. In the illustrated embodiment, the cutting tool 18 may operate as an expandable underreamer that has been expanded beneath the cased section 14. As the drill string 12 is rotated and weight-on-bit is applied, the drill bit 20 extends a pilot hole 22 downwards while the underreamer opens the pilot hole 22 to a larger diameter borehole 24. In embodiments in which a portion of the casing 15 is to be removed, the cutting tool 18 represents a casing or section mill with fixed or expandable blades or cutter blocks that are arranged and designed to remove the casing. Cutting tool 18—whether operating as a reamer to enlarge the borehole or as a casing or section mill to remove casing—may be run with or without the drill bit 20.

The drilling rig is provided with a system 26 for pumping drilling fluid from a supply 28 down the drill string 12 to the cutting tool 18 and the drill bit 20. Some of this drilling fluid flows through passages in the cutting tool 18 and flows back up the annulus around the drill string 12 to the surface. Other portions of the drilling fluid flow from the cutting tool 18 to the drill bit 20, out nozzles or ports in the drill bit 20, and also flow back up the annulus around the drill string 12 to the surface. The distance between the cutting tool 18 and the drill bit 20 at the foot of the bottom hole assembly is optionally fixed. For instance, when the cutting tool 18 is an underreamer, as the pilot hole 22 is drilled or extended, the enlarged borehole 24 can also be simultaneously extended downwardly.

It will of course be understood that it would be possible to drill without the cutting tool 18 present, so that the drill bit 20 attached to the drill string 12 makes a borehole with the diameter of the drill bit 20 and without widening the borehole or removing casing. It would also be possible to use the same cutting tool 18 attached to drill string 12, although without the drill bit 20 and the part of the drill string 12 shown below the cutting tool 18 in FIG. 1, in order to enlarge a borehole which had been drilled previously or to remove casing that had been previously installed in the borehole.

A drilling tool with instrumented cutters embodying the present disclosure will be described with reference to FIGS. 2 to 23 of the drawings. Although described relative to a drill bit, it will be appreciated by one of ordinary skill in view of the disclosure herein that the described instrumented cutters may be used in other tools including underreamers, milling tools (e.g., section mills, casing mills, lead mills, follow mills, dress mills, watermelon mills, junk mills, etc.), stabilizers, and the like. Additionally, other types of instrumented cutters may also be included, including instrumented cutters with sensors for one or more physical properties. By way of example, U.S. Patent Publication No. 2012/0312599, which is incorporated herein by this reference in its entirety, discloses cutters with instrumentation to monitor wear of the cutters during use, and which can include a strain gauge.

Example cutting tools and cutters of the present disclosure can have several constituent parts. To facilitate an understanding of some embodiments of the present disclosure, the following discussion will include a description of: (a) a drill bit body and PDC cutters, which may be made by existing techniques or which include drill bit shape features specific to the instrumented cutters described herein; (b) structural portions of the instrumented cutters; and (c) strain gauges used in the instrumented cutters and the electrical between multiple strain gauges.

Drill Bit Body and Layout

Figure 2:
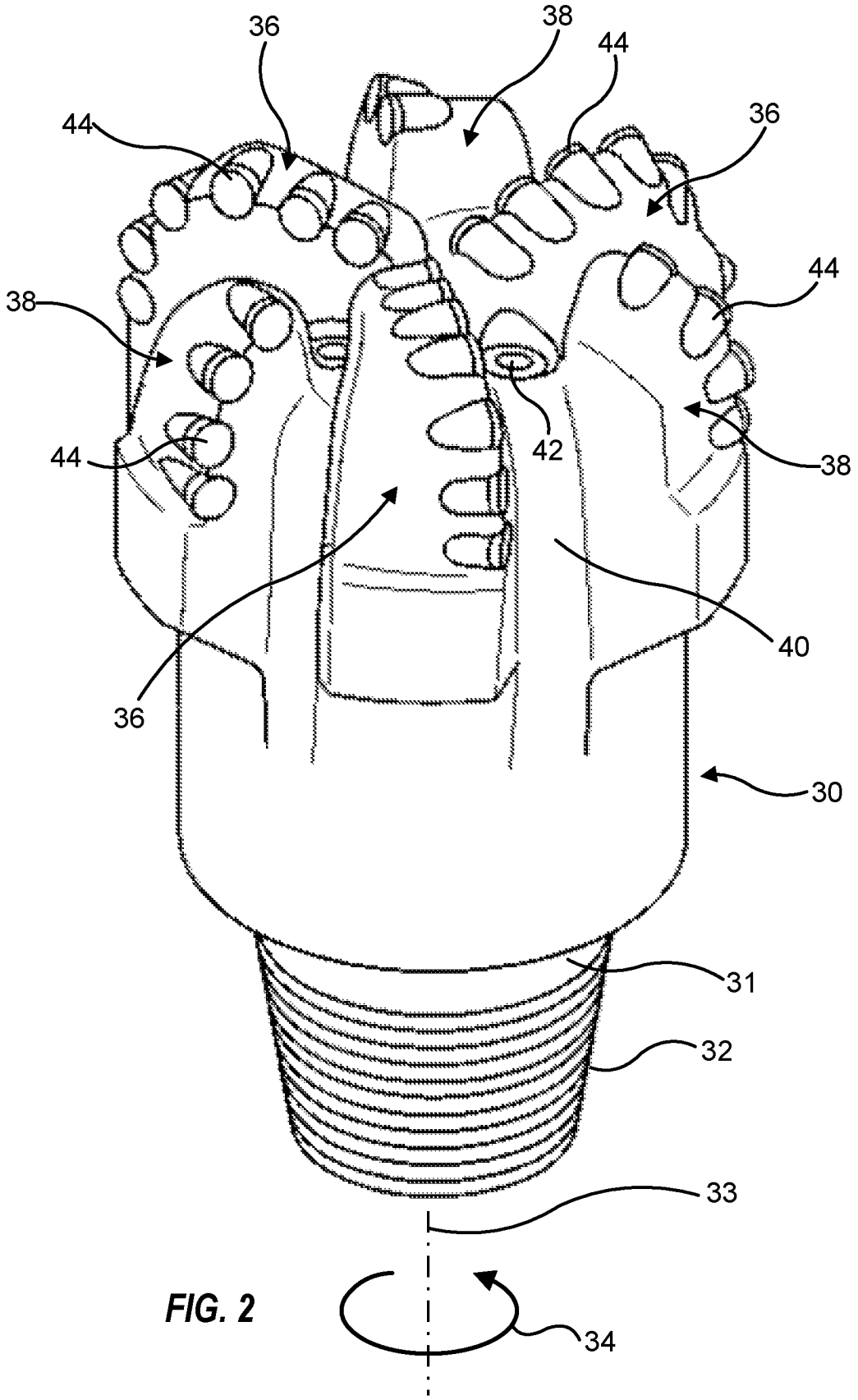
FIG. 2 is a perspective view showing the general arrangement of a fixed cutter drill bit.

FIG. 2 shows the features of an example fixed cutter drill bit fitted with PDC cutters for drilling through formations of rock to form a borehole. This drill bit has a bit body 30 rigidly connected to a central shank 31 terminating in a threaded connection 32 for connecting the drill bit to a drill string to rotate the bit in order to drill the borehole. The bit has a central axis 33 about which the bit rotates in the cutting direction represented by arrow 34.

Cutting structure which is provided on this drill bit includes three angularly spaced apart primary blades 36 alternating with three secondary blades 38. These blades each project from the body of the drill bit and extend radially out from the axis 33. The primary blades 36 begin closer to the axis 33 than the secondary blades 38. These primary blades 36 and secondary blades 38 are separated by channels 40 that are sometimes referred to as junk slots or flow courses. The channels 40 allow for the flow of drilling fluid supplied down the drill string and delivered through apertures 42, which may be referred to as nozzles or ports. Flow of drilling fluid cools the PDC cutters and as the flow moves uphole, carries away the drilling cuttings from the face of the drill bit.

The blades 36, 38 have pockets or other types of cavities which extend inwardly from open ends that face in the direction of rotation. PDC cutters 44 are secured by brazing in these cavities formed in the primary and secondary blades 36, 38 so as to rotationally lead the blades and project from the blades, which exposes the diamond cutting faces of the PDC cutters as shown. The three primary blades 36 are similar to each other but can differ in various ways such as the number and position of cutters 44 coupled to the blades. Similarly, the secondary blades 38 can be similar, but can also differ slightly in the number and position of cutters 44, or in other ways. Additionally, while the blades 36, 38 may be evenly spaced around the axis 33, the drill bit may also some blades that are unevenly spaced to provide an asymmetric blade design.

Figure 3:
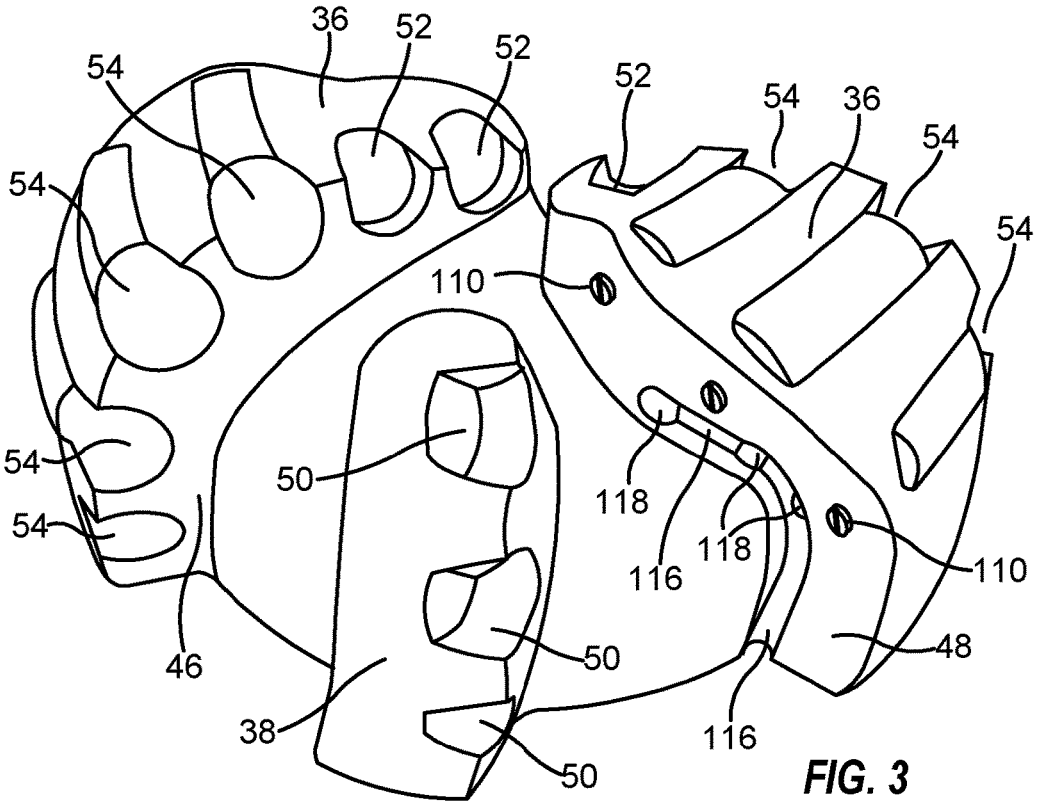
FIG. 3 is a perspective view of a portion of a drill bit body before fitting cutters, according to an embodiment of the present disclosure.

FIG. 3 shows part of the bit body of a drill bit which can be fitted with instrumented cutters as disclosed herein. This embodiment of a bit body can include a number of features similar to those described with reference to, or illustrated in, FIG. 2. The main body of the drill bit is connected to a central shank terminating in an internally or externally threaded connection (see FIG. 2) for connecting the drill bit to a drill string. The bit body of FIG. 3 also includes primary and secondary blades separated by channels as in FIG. 2. FIG. 3 shows one secondary blade 38, the leading face 46 of one primary blade 36 and the trailing face 48 of another primary blade. Nozzles for delivery of drilling fluid may be provided, but are not shown in FIG. 3. In this embodiment, each of the cavities 50 on the secondary blades 38 and the radially inward cavities 52 on primary blades 36 are dimensioned to receive PDC cutters that are secured in these cavities 50, 52 by brazing. Cavities 54, which in this embodiment are radially farther from the bit axis and positioned on the primary blades 36, optionally have a longer length (e.g., measured circumferentially) and can received instrumented cutters, which are described in more detail herein.

Drill bit bodies may be made from a number of materials. For instance, a drill bit body can be machined from steel, additively manufactured from any of a variety of materials (e.g., steel, titanium, Inconel, etc.), cast by placing a molten metal in a mold, or formed from a particulate hard material such as tungsten carbide which is placed in a mold and infiltrated with molten metal binder. An example of a disclosure relating to materials for drill bits is U.S. Pat. No. 8,211,203, which is incorporated herein by this reference. The drill bit shown here in FIGS. 2 and 3 may have a body which is formed in any of these ways or using any suitable material. When the drill bit is formed by infiltrating particulate hard materials, the shank with connection 32 is optionally a steel part which is embedded in the hard particles before infiltration. When molding a drill bit body in this way, the mold may be made from graphite. Interior pathways within the drill bit may be created by placing graphite rods within the cavity defined by the mold and then packing the granular material around such rods.

As noted above, it is also possible 3 to make a drill bit body in other manners, including by using a computer-aided additive manufacturing method which deposits particulate materials of the bit body as a succession of layers. The particulate material is bound together and bound to the previous layer where required in accordance with a digital design. The article initially made in this way from particulate material may be subsequently infiltrated with metallic binder, or may be formed without later infiltration.

Strain Gauges

Example electrical resistance strain gauges consistent with embodiments of the present disclosure observe strain by means of an electrically conductive but somewhat resistive path deposited on a piece of thin sheet (e.g., an electrically insulating polymer) referred to herein as a carrier. The carrier is adhered or otherwise coupled to a substrate to be observed. If stress on the substrate causes it to lengthen slightly, the carrier and the conductive path also lengthen and the resistance of the conductive path increases. Conversely, if there is a force that generates stress which compresses the substrate and shortens the conductive path, the resistance falls. Strain gauges of this type are available from numerous manufacturers and component suppliers including HBM Inc. of Marlborough, Massachusetts, USA, HBM United Kingdom Ltd. of Harrow, UK, and National Instruments of either Newbury, UK or Austin, Texas, USA.

Strain gauges can be formed as pairs in proximity to each another on the same carrier, with the conductive path of one individual gauge at a different angle to the conductive path of the proximate gauge (e.g., running perpendicular to the conductive path of the proximate gauge). Such pairing of gauges can allow for compensation for temperature variation, or to allow one gauge of the pair is to strain to be measured while both exposed to the surrounding temperature. Multiple strain gauges may also be used in combination to enable one strain (e.g., strain in one direction) in a system to be measured separately from another.

Figure 4:
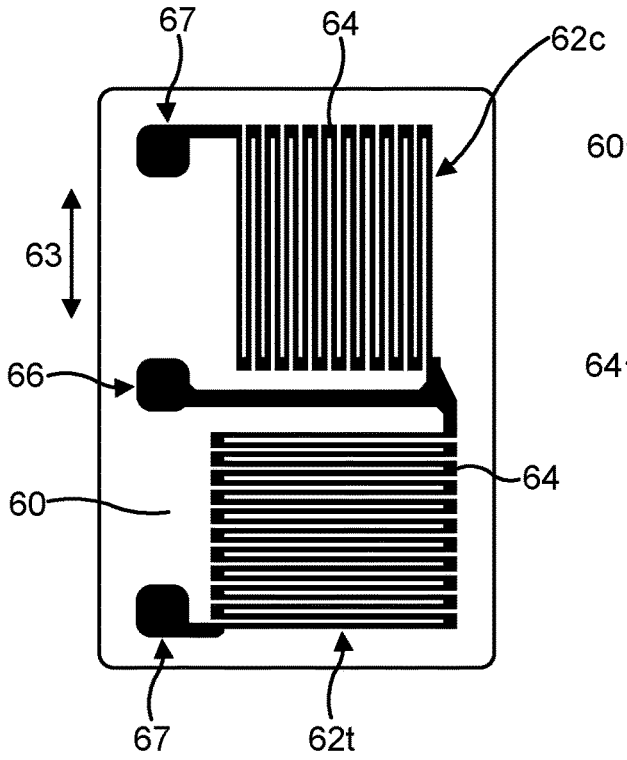
FIGS. 4 and 5 illustrate features of two forms of electrical resistance strain gauges, according to some embodiments of the present disclosure.

An enlarged view of a pair of strain gauges is shown in FIG. 4. The conductive path is deposited or otherwise formed on a carrier 60. In the region 62*c*, a strain gauge is provided by a conductive path which extends to and fro many times parallel to the direction indicated by the double headed arrow 63. This provides a length of conductive path which is subject to strain when the underlying substrate undergoes strain in the direction parallel to arrow 63. If the strain elongates or shortens the carrier 60 parallel to the arrow 63, the conductive path will correspondingly elongate or shorten in this direction causing an increase or decrease in resistance of the conductive path. The reverse turns 64 are thickened as shown to reduce resistance in those parts of the path which are transverse to the direction of arrow 63.

In the region 62*t*, a second gauge is provided by conductive path running to and fro transverse/perpendicular to the arrow 63. The resistance of the conductive path in this region 62*t* is not affected by strain parallel to the arrow 63. As explained in more detail herein, the conductive path in region 62*t* can be used to compensate for the effect of temperature. The conductive paths in regions 62*c* and 62*t* are connected to each other and to a solder tab 66 on the supporting carrier. The other ends of these two conductive paths are connected to separate solder tabs 67. A pair of electrically connected gauges with layout as in FIG. 4 can be referred to as a Poisson gauge.

Figure 5:
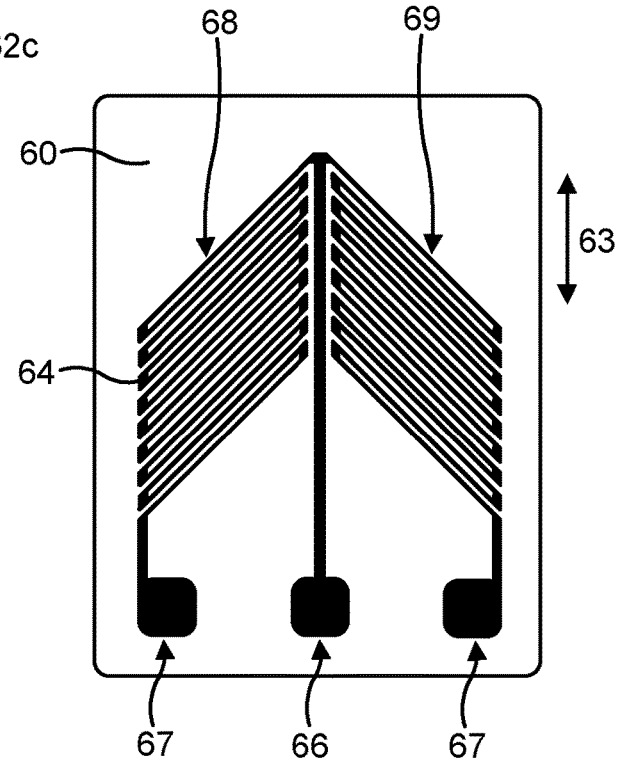

FIG. 5 shows another example of a pair of strain gauges provided by conductive paths on a single carrier 60. Here too, each strain gauge is provided by a conductive path which extends to and fro many times in one direction. In the region 68, and also in the region 69, the conductive paths are at 45° to the direction of the arrow 63, but the conductive path in region 69 extends perpendicular to that in region 68. As before, the two gauges are connected together and to a common solder tab 66, while the other ends of the two conductive paths are connected to respective solder tabs 67. A pair of gauges with configuration shown in FIG. 5 can be referred to as a chevron gauge.

Figure 6:
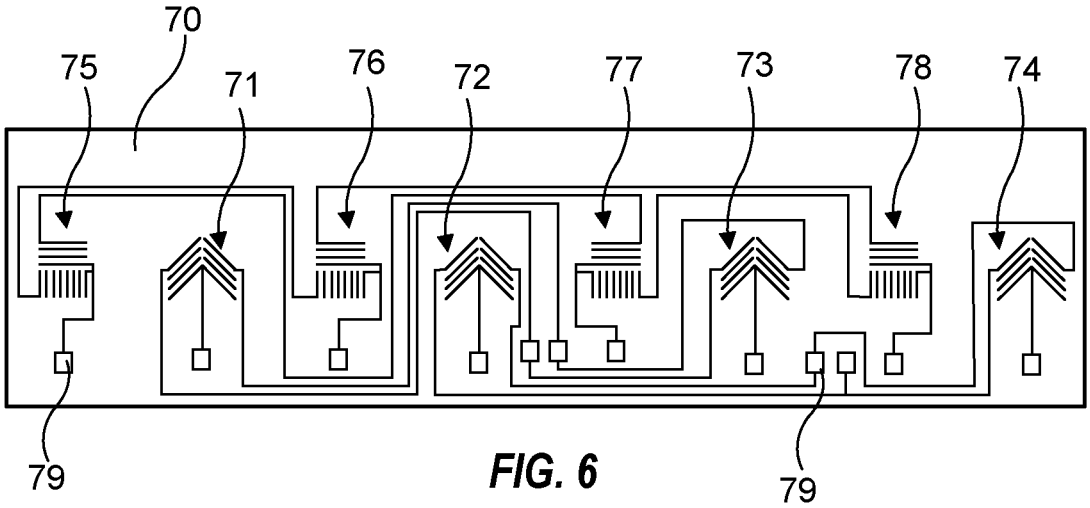
FIG. 6 is a top view of a group of interconnected strain gauges on a carrier, according to some embodiments of the present disclosure.

FIG. 6 diagrammatically shows a group of strain gauges on a single rectangular carrier 70, for use in some embodiments of an instrumented cutter described herein. At each of the positions 71, 72, 73, and 74 there is chevron gauges of the kind shown in FIG. 5. At each of positions 75, 76, 77, and 78 there is a Poisson gauge incorporating one gauge with conductive paths parallel to the length of the carrier and one gauge with conductive parts transverse to the length of the carrier. Connections from solder pads 79 and connections between the gauges are also deposited or otherwise formed on the rectangular carrier 70.

Instrumented Cutter

Figure 7:
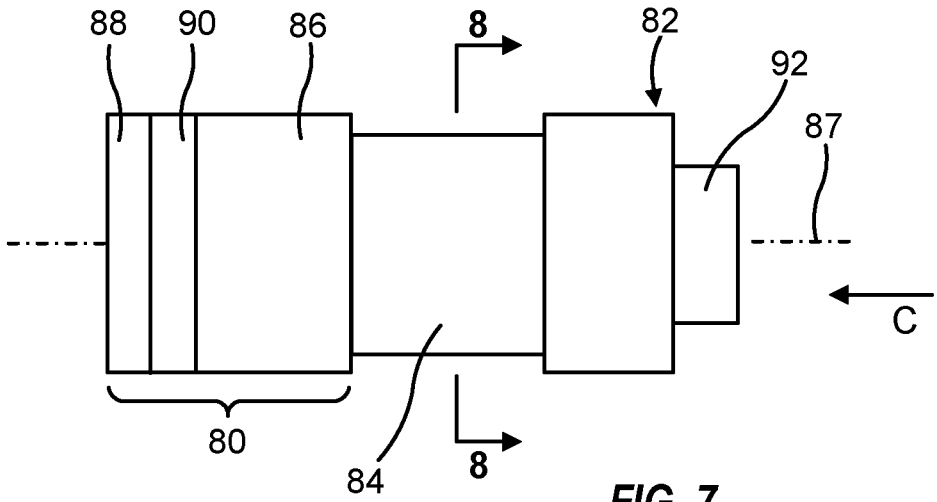
FIG. 7 is an enlarged side view of an instrumented cutter, according to an embodiment of the present disclosure.

FIG. 7 is a side view of an example instrumented cutter having a body with an outer end portion 80, an inner end portion 82, and a connecting section 84 extending between the outer and inner end portions 80, 82. In this embodiment, the outer end portion 80 includes a solid cylinder centered on the axis 87 of the instrumented cutter. The outer end portion 80 can include a cylinder 86 attached to a PDC cutter, and which has the same diameter as the PDC cutter. The cylinder 86 may be formed of the material as a substrate of the PDC cutter, or may include other materials (e.g., steel). The PDC cutter includes a polycrystalline diamond cutting face 88 formed integrally with, or otherwise attached to, a substrate 90. The diamond cutting face 88 can be formed from diamond crystals or particles packed together and sintered with a binder, while the substrate 90 can include tungsten carbide particles, also sintered with a binder. While the diamond cutting face 88 is shown as having a planar outer end surface, in some embodiments, the diamond cutting face 88 can be non-planar. For instance, the diamond cutting face may be pointed (e.g., conical, frustoconical, ridged, chisel-shaped, etc.), concave, have serrated features, or the like.

In this embodiment, the inner end portion 82 is also cylindrical, but can be integral with or otherwise attached to a further portion 92. In some embodiments, the further portion 92 has a square, rectangular, or other polygonal cross-sectional shape, although it could also be circular. As shown in FIG. 9, the further portion 92 is illustrated with an illustrative square cross-sectional shape. The connecting section 84 which extends between the inner and outer end portions 82, 80 can be solid or, as shown in the cross-section of FIG. 8 taken along line 8-8 of FIG. 7, can be hollow or have an interior cavity therein.

In some embodiments, a carrier 70 carrying strain gauges (e.g., strain gauges 71-78 of FIG. 6) can be adhered or otherwise coupled to an inside surface of the connecting section 84. As shown diagrammatically in FIG. 8, the length of the carrier may be chosen so that it extends fully around the inside of the cylindrical connecting section 84 with only a small gap 94 between its ends (e.g., less than 20%, less than 10%, less than 5%, or less than 2% of the circumference of the inner surface), or with no gap at all. The length of the carrier 70 and the position of the gauges 71-78 on the carrier 70 can be arranged and designed such that when the carrier 70 is in position within the cylindrical section 84, certain gauges may be diametrically opposed. For instance, the chevron gauges 71 and 73 can diametrically opposite each other, and other or additional pairs of gauges (e.g., chevron gauges 72 and 74, Poisson gauges 75 and 77, or Poison gauges 76 and 78) can diametrically opposite each other.

Fabrication

Figure 8:
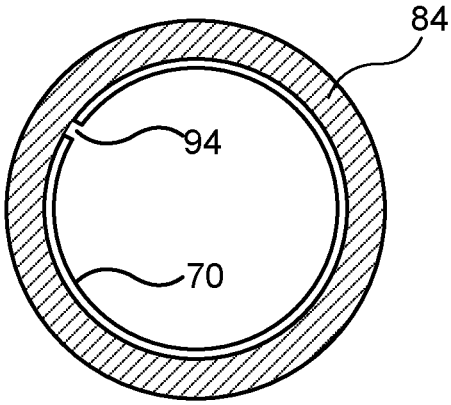
FIG. 8 is an enlarged cross-sectional view of an instrumented cutter along line 8-8 of FIG. 7.
Figure 9:
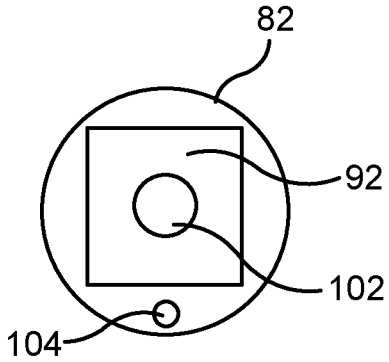
FIG. 9 is an end view of the instrumented cutter of FIG. 7, taken in the direction of arrow C of FIG. 7.
Figure 10:
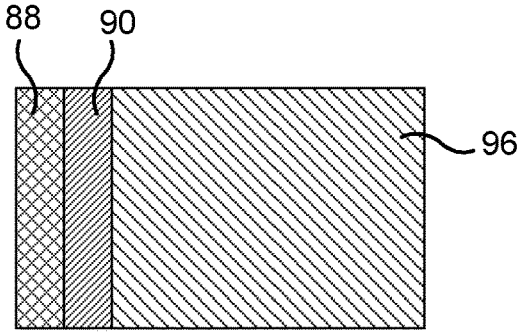
FIGS. 10 to 15 are longitudinal cross-sectional views of a cutter, showing example stages in the manufacture of the cutter.

FIGS. 10 to 15 are cross-sectional views of an instrumented cutter to illustrate an example manufacturing process for making the cutter of FIGS. 7 to 9 as two component parts which are then joined together. In a first step shown in FIG. 10, the substrate 90 of a PDC cutter is attached to a solid cylinder 96 of the same diameter to give the article shown in FIG. 10 (e.g., by brazing). The embodiment shown in FIG. 10 may be generally to scale for some embodiments, but is not to scale for other embodiments. For instance, the substrate 90 may be longer as compared to the cutting face 88. As noted above, the solid cylinder 96 may be formed of any suitable material, including any of various grades of steel.

Figure 11:
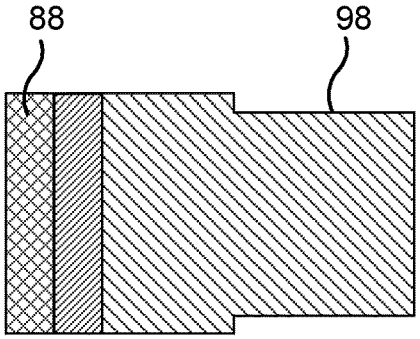
Figure 12:
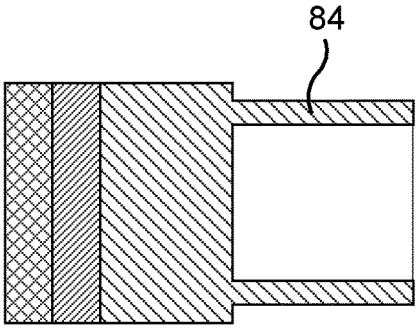

As shown in FIG. 11, the cylinder 96 can be machined (e.g., on a lathe) along part of its length as shown at 98, to reduce a diameter of a portion of the length of the cylinder 96 to the external diameter of the connecting section 84. After this, and as shown in FIG. 12, a blind bore can be drilled or formed into the cylinder 96. In this particular embodiment, the length of the bore is about equal to the length of the machined portion 98 of the outer diameter of the cylinder 96. With the bore formed, the machined portion defined the connecting portion 84 and has a reduced diameter and is a hollow cylinder integral with the outer end portion 80.

Figure 14:
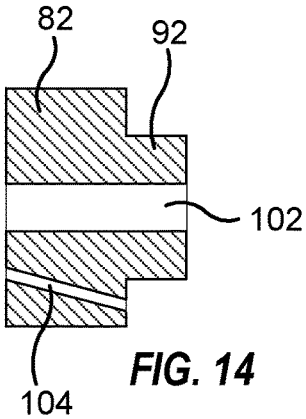

A second component part, shown in FIG. 14, can be made by machining of a cylinder (e.g., of steel or other material) to form the square end portion 92 at one end. The remainder of that cylinder then forms the inner end portion 82. A threaded bore 102 is optionally made along a full or partial length of the second component part, and optionally along the axis. In some embodiments, a small hole 104 (see also FIG. 9) is drilled through the inner end portion. The small hole 104 may be angled as shown in FIG. 14, but in other embodiments may be parallel to the axis of the instrumented cutter, parallel to threaded bore 102, or a combination thereof.

Figure 13:
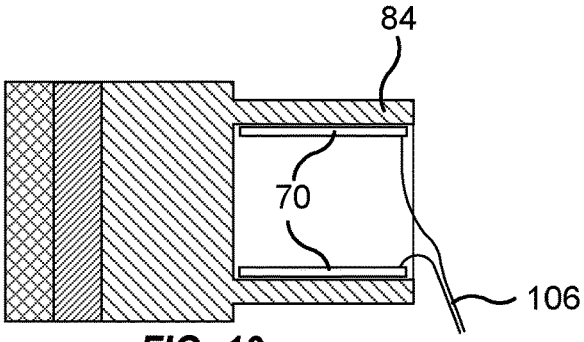

The carrier 70, with attached connecting wires 106 (only two of these are shown) is adhered or otherwise coupled to the inside of the cylindrical connecting section 84, as shown in FIG. 13. Adhesives for attaching strain gauges to steel and similar materials are available from manufacturers of strain gauges and may include a two-part epoxy adhesive. Next, the two-parts shown in FIGS. 13 and 14 can be brought together, threading the connecting wires 106 through the hole 104. The connecting section 84 can then be welded, brazed, or otherwise coupled to the inner end portion 82. For instance, electron beam welding may be used to make the instrumented cutter shown in FIG. 15.

It will be appreciated in view of the disclosure herein, that the method illustrated in FIGS. 10-15 is merely illustrative. In other embodiments, the order or processes can be changed or combined. For instance, the cylinder 96 may be molded or machined to shape (e.g., with bore and reduced outer diameter) before attachment to the substrate 90. Similarly, the further component 82 may be attached to the cylinder 96 before attachment to the substrate 90.

Figure 16:
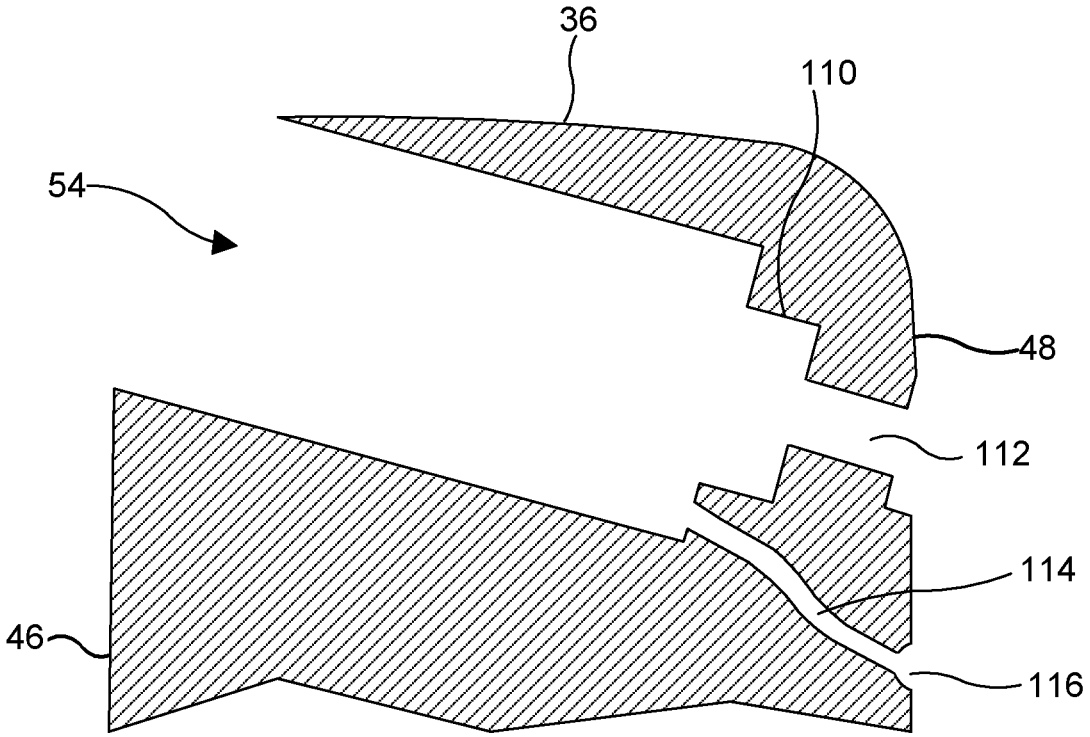
FIG. 16 is a cross-sectional view of a blade of a drill bit, showing a cavity to receive a cutter.

FIG. 16 shows a section through a cavity 54 in a primary blade 36 of the drill bit. At the inner end of the cavity the drill bit body has a square recess 110 to receive the square end 92. There is a through hole 112 for a bolt and a through passage 114 from the inner end of the cavity to the trailing face 48 of the blade. This passage 114 leads to a channel 116, more clearly seen in FIG. 3, along the trailing face of the blade. The mouths 118 of three passages 114 are indicated in FIG. 3.

Figure 15:
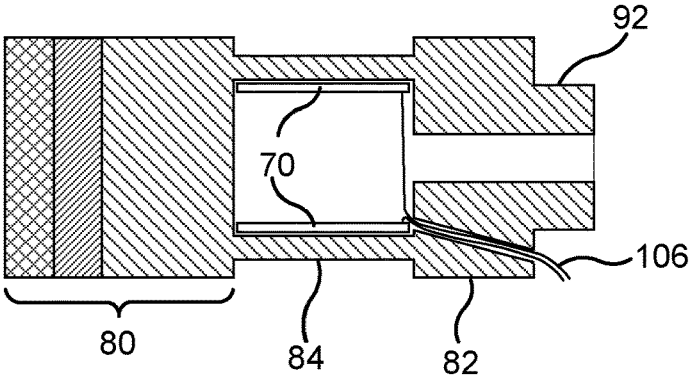
Figure 17:
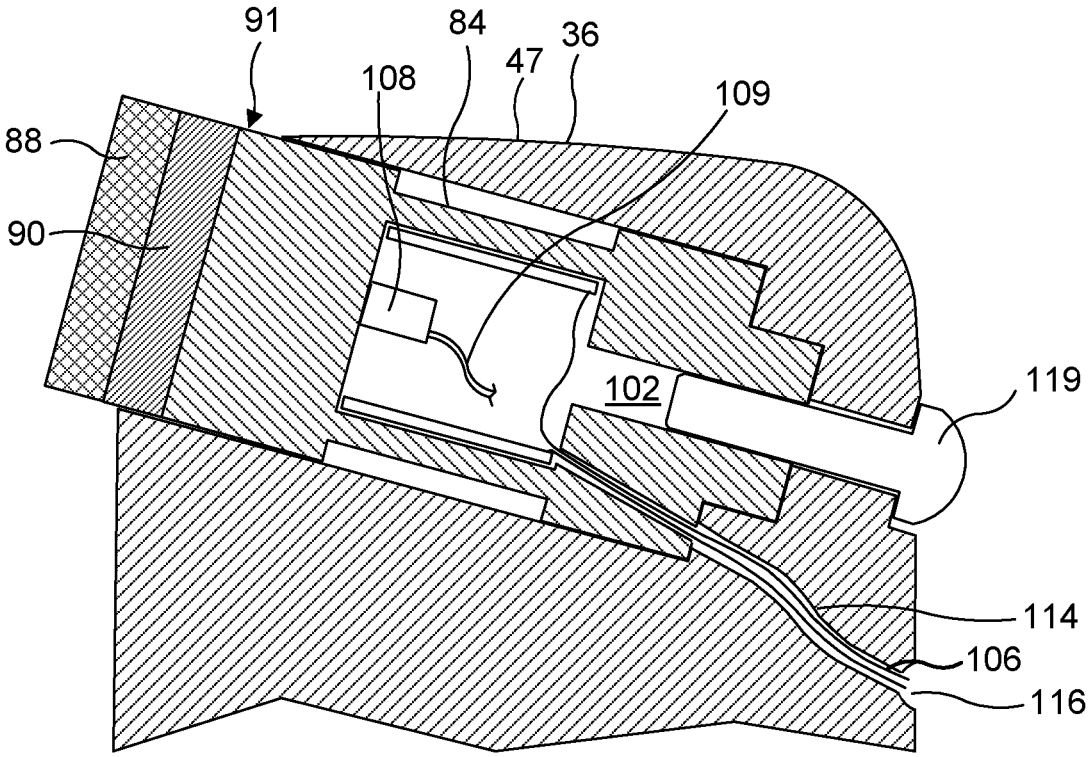
FIG. 17 is a cross-sectional view of the blade of FIG. 16, with a cutter in place within the cavity in the blade.

A cutter as shown in FIG. 15 is inserted into the cavity 54 to the position shown in FIG. 17, while passing the wires 106 from the strain gauges through the passage 114. The angle of the cavity, relative to the axis of the drill bit body, positions the cutter at an angle to the central axis of the drill bit and so the cutter projects from the blade, as shown. The PDC disc 88 is exposed and some more of the outer end portion 80 is also exposed, as indicated at 91. The reminder of the outer end portion 80, the connecting section 84 and the inner end portion 82 are inside the cylindrical cavity 54 in the blade 36 of the drill bit. When the cutter is inserted into the cavity, the square portion 92 fits into the corresponding recess 110 at the inner end of the cavity and prevents any rotation of the cutter in the cavity. When the cutter is fully inserted it is secured in place by a bolt 119 into its threaded bore 102.

The inner end portion 82 of the cutter is dimensioned to be an interference fit at the inner end of the cavity 54. The outer end portion 80 is dimensioned to be a sliding fit in the cavity, with only a small spacing between the outer end portion 80 and the surrounding wall of the cavity. In consequence of this arrangement, force applied to the PDC disc 88 along the axial direction of the cutter (i.e. the axial load on the cutter) is transmitted through the connecting section 84 to the inner end portion 82 and from there to the blade 36 of the drill bit. This stress causes strain, which is elastic compression of the connecting section 84.

Components of force on the PDC disc 88 which are not in the axial direction of the cutter will also be transmitted to the connecting section 84 and will cause strain which is bending of the connecting section 84. This is limited by the outer end portion 80 abutting against the wall of the cavity 56 and so the bending deformation of the connecting section 84 does not exceed its elastic limit.

The wires 106 lead along the channel 116 at the trailing face 48 of the blade 36 and are led from there to an electronics package which is contained within a bottom hole assembly at the downhole end of the drill string 12 and which operates the strain gauges and records the measured data or sends it onwards to the surface using a known form of telemetry from a downhole tool to the surface, such as mud pulse telemetry or by using wired drill pipe. Such an electronics package may for instance be contained within measuring-while-drilling (MWD) equipment located in the drill string close to the drill bit. It is possible that the electronics package will carry out some signal processing before signals are sent on to the surface. It is also possible that the wires 106 lead to some electronics accommodated within the drill bit itself, which then send signals onwards to MWD equipment for further processing and/or transmission to the surface. It is also possible that electronics within the drill bit itself will have the capability to transmit to the surface.

When the cutters and the wires 106 have been put in place, the passages 114 and channel 106 are filled with electrically insulating flexible filler material which is an organic polymer. This may be a silicone polymer or a polyurethane polymer and it may be introduced as a liquid which then cures in place. This filler material may be a continuous mass of polymer or it may be a closed cell foam. In either case, the flexible filler serves to exclude drilling fluid and protect the wiring.

In the embodiment shown here, the inner end portion 82 is secured in position by a bolt holding the square end portion 92 in a corresponding recess 110. Other methods of attachment are possible, such as a weld or an adhesive.

It is possible that another type of sensor could also be inserted into the space within a connecting section 84. This is illustrated in FIG. 17 where there is a temperature sensor 108 within this connecting section. Electrical connections 109 to this sensor have been shown incomplete in FIG. 17 but would be led out through the passage 114.

Function of the Strain Gauges

The four Poisson gauges 75-78 are used to measure axial force on the outer end of the cutter, separately from any components of force transverse to the axial direction. The chevron strain gauges 71 and 73 are located diametrically opposite each other in the connecting section 84. The chevron strain gauges 72 and 74 are also diametrically opposite each other. A notional diameter between the gauges 72 and 74 is orthogonal to a notional diameter between the gauges 71 and 73. These pairs of diametrically opposite chevron gauges are used to measure strains caused by shear force components in each of two directions which are perpendicular to each other and also perpendicular to the axis of the cutter. The measurement of force by the strain gauges can thus resolve the force into an axial component and shear components in these two perpendicular directions perpendicular to the cutter axis.

It is well-known to use a Wheatstone bridge circuit to measure the change in resistance of strain gauges. It is also known to use multiple gauges, in a Wheatstone bridge, to separate strains and the forces causing them into different parts. However, the measuring arrangement used for this embodiment contains distinctive features which will now be described.

The four Poisson gauges 75-78 on the carrier 70 are interconnected but are not connected to any of the chevron gauges 71-74. They are connected in a Wheatstone bridge with two gauges in each arm of the bridge. This is shown by FIGS. 18 and 19.

Figure 18:
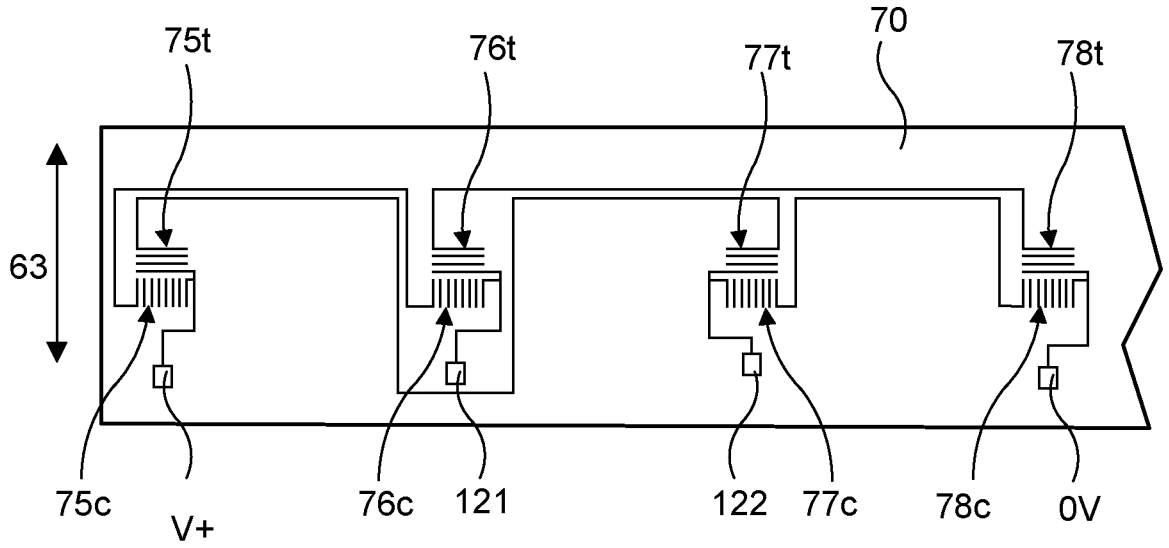
FIG. 18 is a top view of a carrier such as that of FIG. 6, with only Poisson gauges shown.

FIG. 18 shows the carrier of FIG. 6 with the Poisson gauges 75-78 and their electrical connections, but does not show the chevron gauges 71-74 and connections to those gauges. As already shown by FIG. 4, each Poisson gauge is made up of two individual strain gauges with conductive paths perpendicular to the other. The individual strain gauges denoted as **75*c*-78*c* have conductive paths parallel to the arrow 63 which is parallel to the axis of the cutter. The individual strain gauges denoted as 75*t*-78*t* have conductive paths orthogonal to the arrow 63**.

Figure 19:
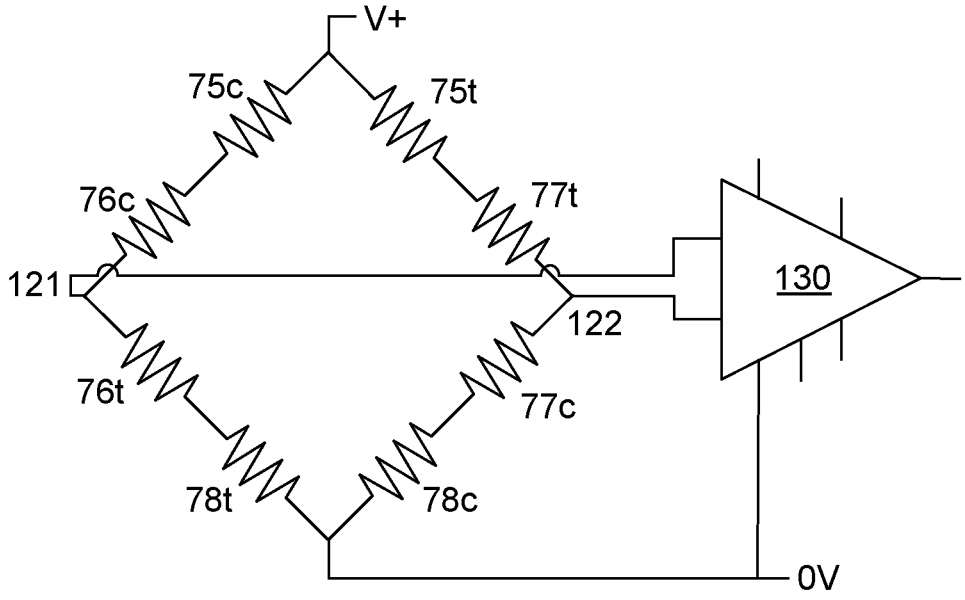
FIG. 19 is an example circuit diagram of the gauges shown in FIG. 18.

Connections to the Poisson gauges are included in FIG. 18 and are also shown as a circuit diagram by FIG. 19 which shows how the individual strain gauges are connected in a Wheatstone bridge. Connections to ground and a fixed supply voltage are indicated as 0V and V+ respectively. Connections 121 and 122 are outputs from the Wheatstone bridge and these are connected as inputs to differential amplifier 130.

Axial load applied to the outer end portion 80 of the cutter compresses the connecting section 84 and the carrier 70 in the axial direction indicated by arrow 63 thereby shortening the conductive paths of gauges **75*c*-78*c* and reducing their resistance. The gauges 75*t*-78*t* are not affected. Consequently the potential of 121 increases and the potential of 122 decreases. The resulting change in potential difference between 121 and 122 is amplified by the differential amplifier 130** and is a measurement of axial strain and hence of axial load.

The resistances of the strain gauges may change with temperature but so long as this affects all the gauges equally, changes will be the same in all four arms of the Wheatstone bridge and so will not significantly alter the potential difference between 121 and 122.

Shear force on the outer end portion 80 of the cutter will stretch one or two of the gauges 75*c*-78*c* while compressing the diametrically opposite gauge(s) by an equal amount. The net result is that there is no change to the output. For example, if a strain stretches 75*c* and compresses the opposite gauge 77*c* while leaving everything else unchanged, potential at 121 will drop because of the increase in resistance of gauge 75*c*. The potential of 122 will also drop by substantially equal amount because of the decrease in resistance of gauge 77*c* and consequently the potential difference between 121 and 122 will remain substantially unchanged. Stated more generally, when strain stretches any one of the gauges and compresses the diametrically opposite gauge, the changes in resistance in two arms of the Wheatstone bridge shown in FIG. 19 will substantially compensate. In this way the four Poisson gauges and their connections in the Wheatstone bridge are able to separate axial load from shear forces and measure only the axial load.

Figure 20:
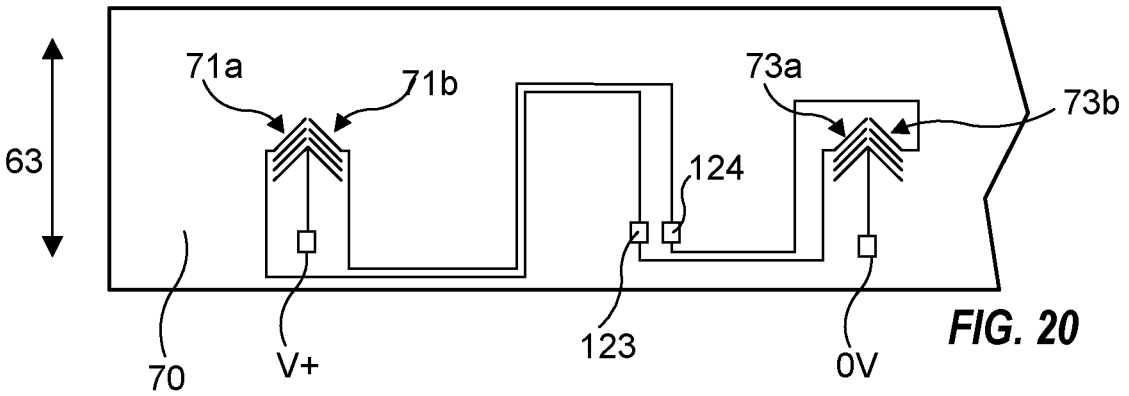
FIGS. 20 and 22 are top views of a carrier such as that of FIG. 6, with only one pair of connected chevron gauges shown.
Figure 21:
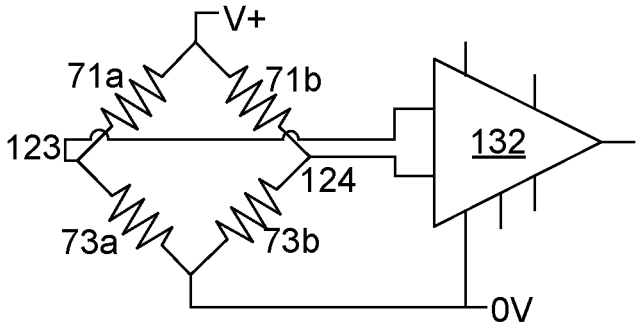
FIGS. 21 and 23 are example circuit diagrams of the gauges shown in FIGS. 20 and 22, respectively.

FIG. 20 shows part of the carrier of FIG. 6 with the diametrically opposite chevron gauges 71 and 73 together with their electrical connections. Poisson gauges 75-78, chevron gauges 72 and 74 and their electrical connections are omitted. The chevron gauges 71 and 73 shown in FIG. 20 are each made up of two individual gauges as was shown in FIG. 5 with conductive paths orthogonal to each other and at 45° to the axial direction shown by arrow 63. These are indicated here as 71*a*, 71*b*, 73*a*, and 73*b*. FIG. 21 shows the circuit diagram. Outputs 123 and 124 from the Wheatstone bridge are inputs to differential amplifier 132.

Figure 22:
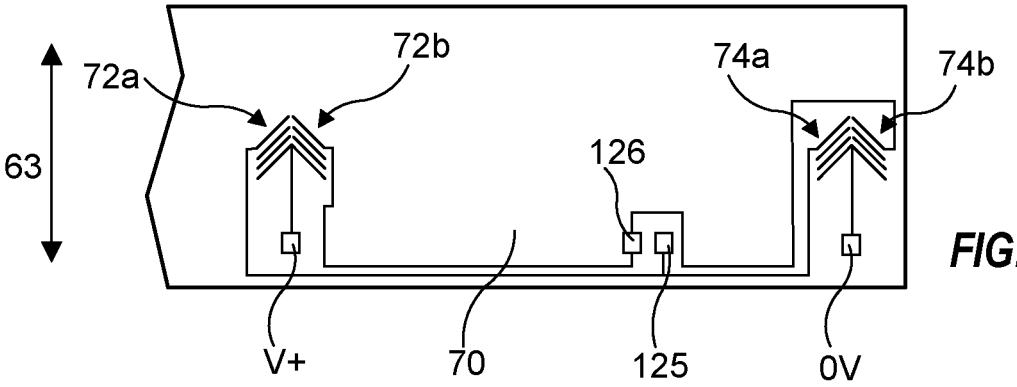
Figure 23:
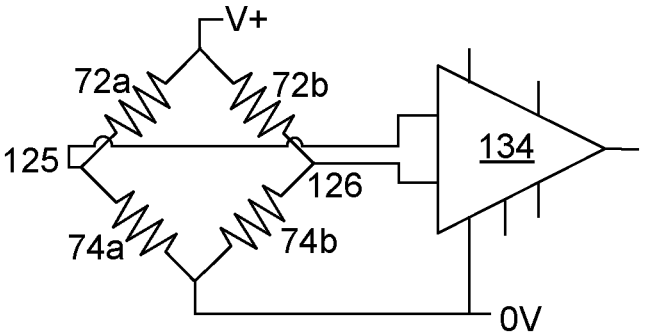

FIGS. 22 and 23 are directly analogous to FIGS. 20 and 21 but show the chevron gauges 72 and 74 with their connections. The individual gauges are again connected as a Wheatstone bridge with outputs 125 and 126 connected as inputs to differential amplifier 134.

Axial load on the cutter outer portion 80 will compress its connecting section 84 and the chevron strain gauges. However, all the individual gauges will be compressed equally and so the potential differences between 123 and 124 and likewise between 125 and 126 will not change. This will also be the case with any changes of temperature. Thus the chevron gauges separate and ignore axial load on the cutter.

Figure 24:
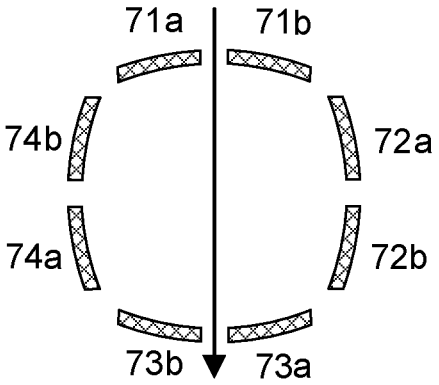
FIG. 24 is a diagrammatic axial view of multiple chevron gauges as they may be positioned on an instrumented cutter, according to an embodiment of the present disclosure.

FIG. 24 is a diagram indicating the positions of the chevron gauges in an axial view. For the purpose of explanation, it is assumed that a shear force acts in the direction of the arrow, parallel to the diameter between gauges 71 and 73. This will give a strain in which the conductive paths of gauges 71*a* and 71*b* are stretched equally and those of gauges 73*a* and 73*b* are compressed equally. It can be seen from FIG. 21 that the changes in resistance will alter the potentials at 79*c* and 79*d* by an equal amount, and so there will be no change in the potential difference between 123 and 124. Looking again at FIG. 24, the strain also stretches the gauges 72*a* and 74*b* while compressing 74*a* and 72*b*. It can be seen from FIG. 23 that this will lower the potential at 125 while raising the potential at 126. This produces a change in potential difference between these two points, which is amplified by differential amplifier 134. So the effect of shear force on the diameter between gauges 71 and 73 is measured by gauges 72 and 74 and ignored by gauges 71 and 73. Correspondingly, any shear force along the diameter between gauges 72 and 74 is measured only by gauges 71 and 73.

The overall consequence is that the outputs from the chevron gauges exclude axial load on the cutter and provide separate measurements of shear force components in directions perpendicular to each other and perpendicular to any axial load. Because the changes in potential difference from the Wheatstone bridges are small, they are amplified downhole by the differential amplifiers or other electronic circuitry. As mentioned above, this may be located in a compartment within the drill bit, or in a measuring sub in the drill string close to the drill bit.

When the rotary tool (in this embodiment a drill bit) is downhole in a well, the downhole fluid pressure will apply axial force to the cutter and hence apply a constant compressive stress to the connecting section 84. This may be observed as a baseline value which is offset from the value when the drill bit is at the surface. If this baseline is measured while the drill bit is not rotating, the measurement of compressive axial strain of the connecting section 84 and hence of axial load on the cutter will provide a measurement of downhole pressure. However, since it is likely to be inconvenient to stop drilling to make such a measurement, a pressure sensor may be provided on the exterior of the drill bit.

In the circuits above, each Wheatstone bridge is supplied with fixed voltage and voltage difference across the bridge is connected to a differential amplifier or other electronic circuitry amplifying the changes in voltage brought about by strain and consequent change in the resistance of the strain gauges in the Wheatstone bridge. However, electronic circuits which rely on maintaining constant current rather than constant supply voltage are also known and may be used.

Reamer

Figure 25:
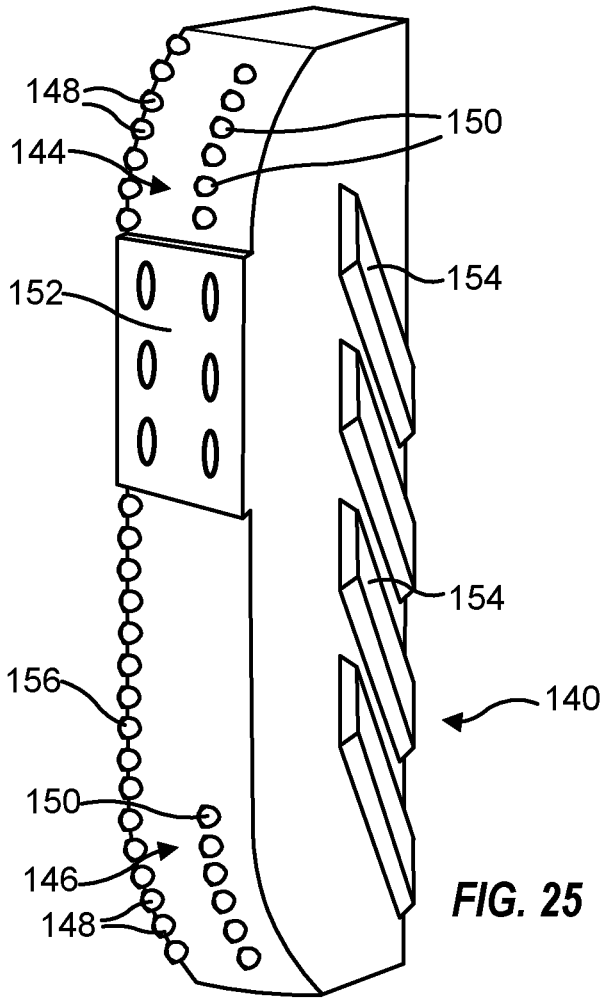
FIG. 25 is a perspective view of a cutter block for an expandable reamer.
Figure 26:
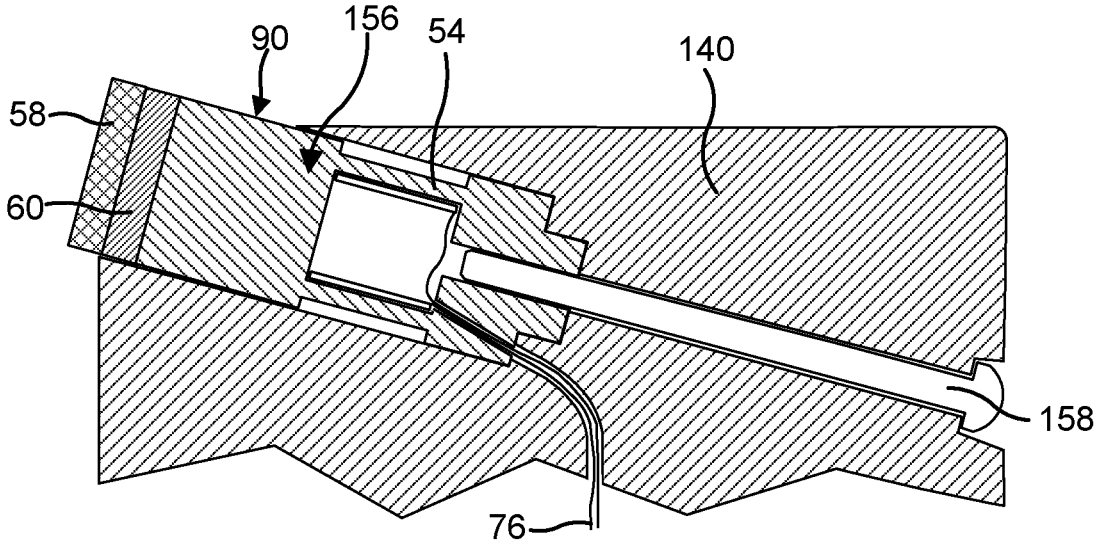
FIG. 26 is a longitudinal cross-sectional view of the cutter block of FIG. 25, showing an instrumented cutter within a cavity in the cutter block, according to an embodiment of the present disclosure.

A cutter as described above with reference to FIGS. 7 to 24 may be used in other rotary cutting tools. FIGS. 25 and 26 illustrate incorporation into a reamer block. WO2015/085288 (which is incorporated herein by reference) is one of several documents describing a rotary tool which is an under reamer for enlarging a borehole. In this tool the expansion of three cutter blocks from a cylindrical tool body is brought about by a mechanism which uses the pressure of drilling fluid to drive cutter blocks upwardly. The cutter blocks have protruding splines which are at an angle to the tool axis and fit into matching channels which are part of the cutter body. Consequently when the blocks are pushed upwardly in unison, the splines slide in the matching channels and guide the blocks to expand radially in unison.

FIG. 25 is a perspective view of a cutter block 140 which is very similar to the cutter block shown in FIG. 4 of WO2015/085288. This block is one of three blocks distributed azimuthally around the body of the rotary tool. This block 140 has upper and lower cutting regions 144, 146 on which hard surfaced cutters are mounted in a leading row of cutters 148 and a following row of cutters 150. Between these regions there is an axially middle section where the cutters are a front row only and which includes a stabilising pad 152. This stabilising pad does not include cutters but has a generally smooth front surface positioned to face and slide over the borehole wall. Most of these cutters are conventional PDC cutters brazed in cavities in the steel block 140. Splines 154 on the block 140 guide its upward and outward travel as described in WO2015/085288.

Cutter 156 within the leading row of cutters 148 in FIG. 25 is an instrumented cutter generally as described above but with a longer outer portion 80. FIG. 26 is a cross section through this cutter and the upper part of the block 140. As can be seen the arrangement is very similar to that seen in FIG. 17. The cutter is secured in place in a cavity by a long bolt 158 inserted through the trailing face of the cutter block 142. The diamond disc 88 is exposed, and some more of the outer portion 80 is exposed as indicated at 120. The wires 106 are led through the block 140 and connected to electronics located in a compartment within the tool.

Mill

Figure 27:
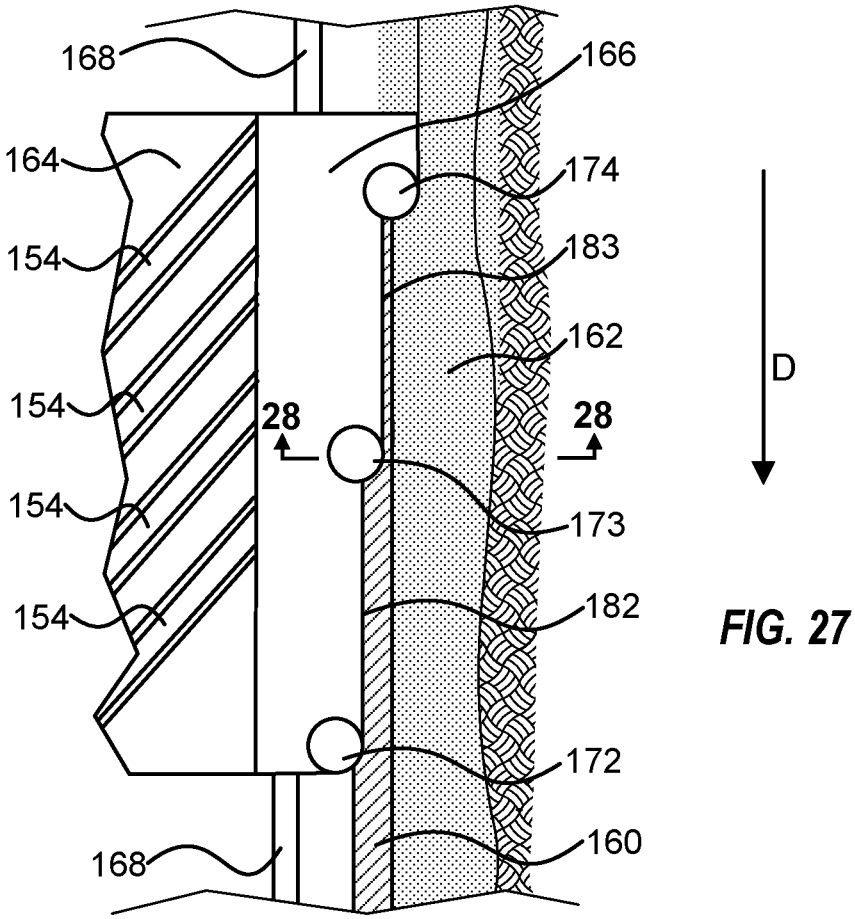
FIG. 27 is a side view of a cutter block of a section or casing mill, in use to mill and remove a portion of wellbore casing, according to an embodiment of the present disclosure.

A tool with construction as described in WO2015/085288 can be used as a section mill for removing a length of borehole casing, by fitting the tool with cutter blocks for this purpose. This is illustrated by FIG. 27. As shown in that drawing, an existing borehole is lined with lengths of tubing 160 (the borehole casing) which are joined end to end. Cement 162 has been placed between the tubing 160 and the surrounding rock formation. The tubing 160 and cement 162 may have been in place for some years.

A cutter block fitted to a tool as disclosed in WO2015/085288 has an inner part 164 with angled splines 154 to guide travel to the block when it is expanded. The inner part 164 is attached to an outer part 166. This block is one of three blocks distributed azimuthally around the body of the rotary tool and can be extended outwardly through a slot in the tool body. An edge of this slot is seen at 168.

The outer part 166 of each block is steel and has cutters 172, 173 and 174 secured in cavities therein so that they are partially embedded in the outer block part 126 with their leading ends exposed and facing in the direction of rotation. Cutters 172 and 176 are cylinders of sintered tungsten carbide powder. Cutter 174 is an instrumented cutter very similar to the cutter shown in FIGS. 10 to 15 except that its outer end portion is made up of a steel cylinder 86 brazed to a cylinder 176 of sintered tungsten carbide powder which gives a hard cutting face. It is held in position in the outer block part 166 by bolt 178. Wires 106 from the strain gauges in the connecting section 84 are led down through the outer and inner block parts 166, 164 and connected to electronics located in a compartment within the tool body.

Figure 28:
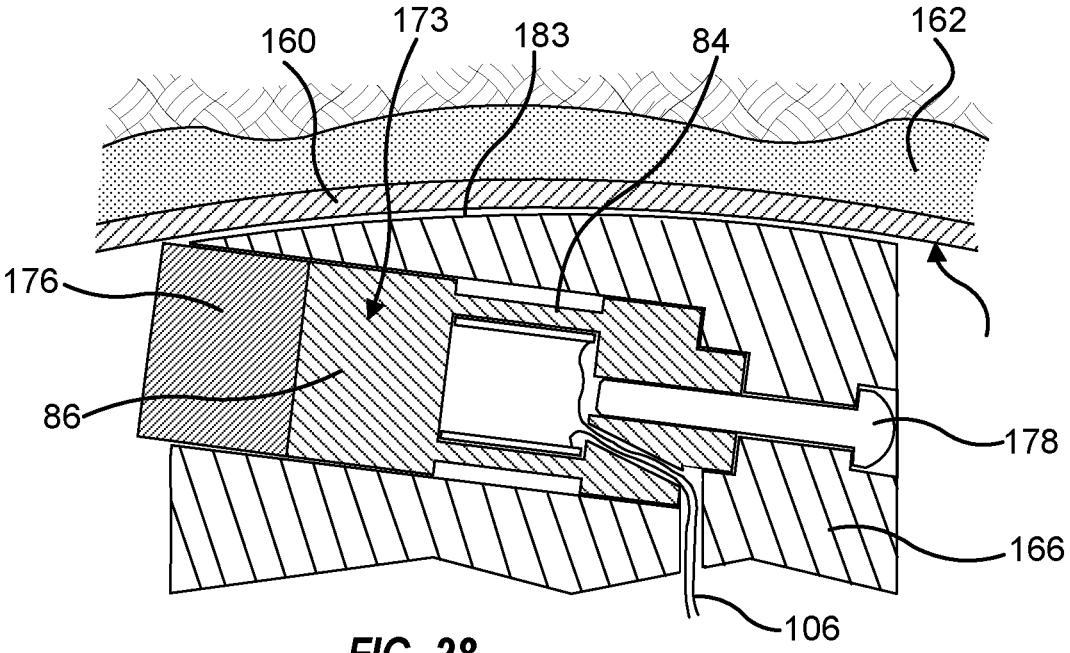
FIG. 28 is a longitudinal cross-sectional view of a cutter on line 28-28 of FIG. 27, according to an embodiment of the present disclosure.

Radially outward facing surfaces 182 and 183 on the outer block part 166 are part-cylindrical with radii such that when the block has been extended from the tool body these surfaces are centered on the tool axis. The surface 183 is at the same distance from the tool axis as the as the radially outer extremity of cutter 173 as seen in FIG. 28. The surface 182 is similarly aligned with the radial extremity of the cutter 172.

For use the tool is attached to a drill string and lowered to the required position within the borehole. The mechanism within the tool body as shown and described in WO2015/085288 is used to push the cutter blocks upwards and outwards while the tool is rotating within tubing which is to be removed. The hard cutters 172, 173, 174 cut outwardly through the surrounding tubing. When the cutter blocks are fully extended, weight is applied to the tool and this pushes the outer block parts 122 down onto the tubing which has been cut through.

The hard cutters 172, 173, 174 of the tool now continuously mill away tubing 160 as the rotating tool advances axially in the downhole direction shown by arrow D. The axially leading cutter 172 on each block 20 is positioned to remove some material from the inside wall of the tubing 120, thus creating a new inward facing surface on the tubing 162. The part cylindrical surface 182 slides on this newly created inner surface of the tubing. The cutters 173 remove a further thickness of tubing 160, creating a fresh inward facing surface on which the surfaces 183 slide. The close fit of surfaces 182, 183 to internal surfaces created on the tubing 160 positions the axis of the rotating tool accurately relative to the tubing 160. As the tool progresses downwardly, the cutter 174 removes the remaining thickness of the tubing 160.

Further Cutter Embodiments

Figure 29:
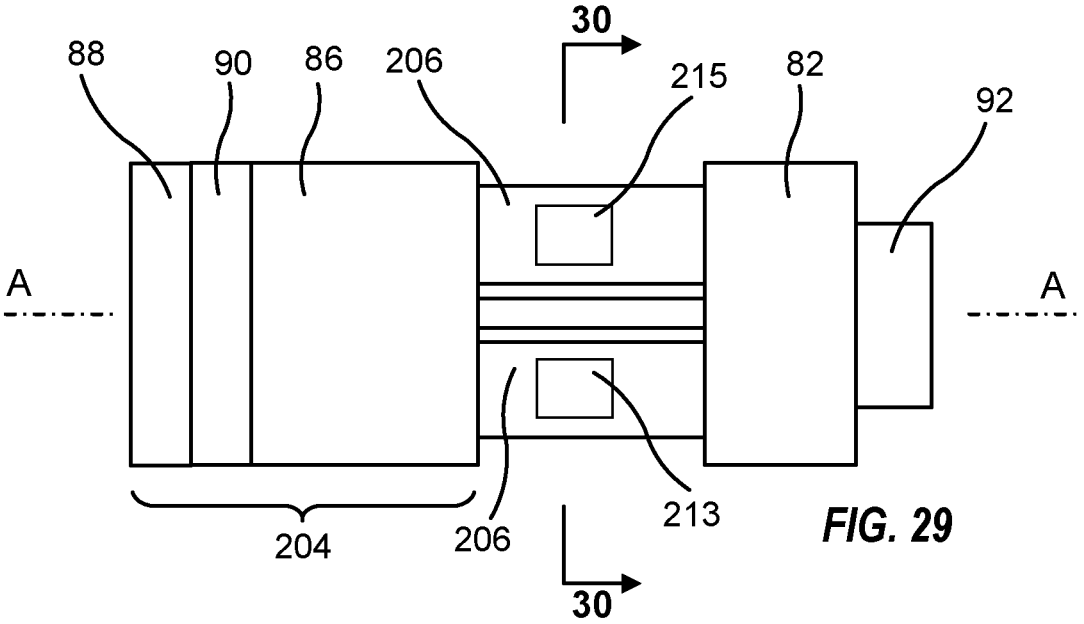
FIG. 29 is an enlarged side view of an instrumented cutter, according to another embodiment of the present disclosure.
Figure 30:
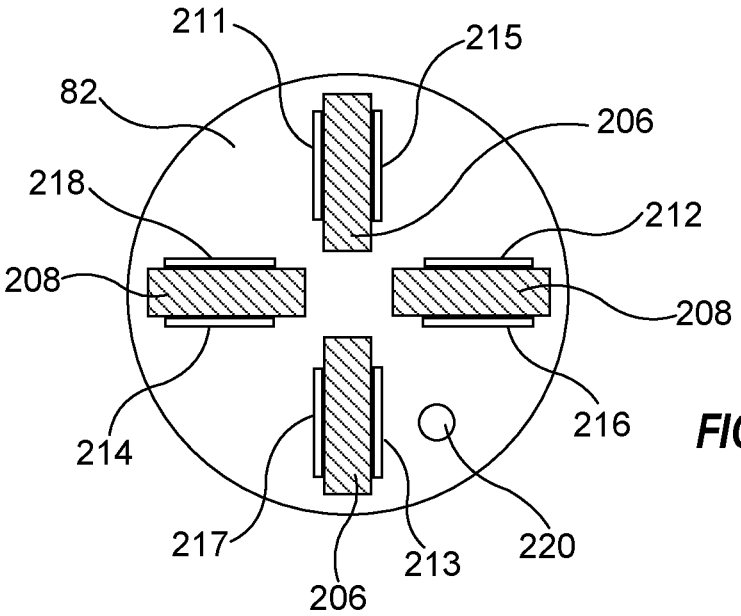
FIG. 30 is a cross-sectional view of an instrumented cutter on the line 30-30 of FIG. 29.

FIGS. 29 and 30 show another form of cutter which could be inserted into the cavity 28 of a drill bit body shown in FIG. 3, or into the cutter block of the reamer of FIG. 25 or the mill of FIG. 27. Similarly to the cutter shown in FIG. 7, the outer end portion 204 comprises a diamond disc 88 integral with a sintered tungsten carbide disc 90 brazed to a steel cylinder 86. The inner end portion is again a cylinder 82 on which is square end 92. The inner and outer end portions are joined by four connecting sections 206 and 208. As seen from the enlarged cross-sectional view which is FIG. 30, the connecting sections 206, 208 are at 90° intervals around the cutter axis so that two of the connecting sections 206 are diametrically opposite one another and other two of the connecting sections 208 are also opposite one another. Each of these connecting sections 206, 208 has a rectangular cross section, as FIG. 30 shows. Chevron shear gauges 211, 212, 213 and 214 which are of the type shown in FIG. 5 are attached to one of the wider faces of each of these connecting sections 206, 208 and Poisson gauges 215, 216, 217 and 218 of the type shown in FIG. 4 are attached to the other broad faces. Wiring which connects these strain gauges 211-218 to an electronics package located within the rotary tool is taken through a hole 220 passing through the inner end portion 82.

The cylinder 86, the inner end portion 82, the square end on the cylinder 92 and all four connecting sections 206, 208 are made as a one piece article by selective laser sintering of steel powder. The tungsten carbide disc 90 of the PDC cutter is then attached by brazing after which the strain gauges 211-218 are adhered to the connecting sections 206, 208.

Figure 31:
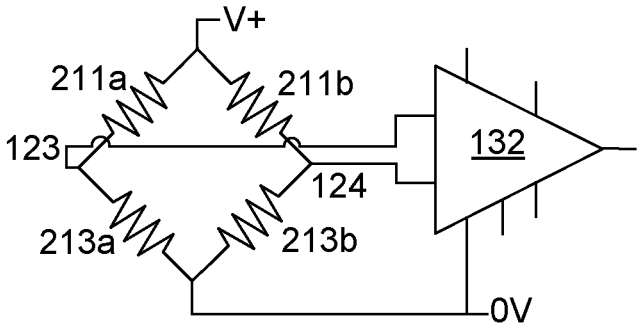
FIGS. 31 and 32 are example circuit diagrams for strain gauges used in the embodiment of FIGS. 29 and 30, according to another embodiment of the present disclosure.
Figure 32:
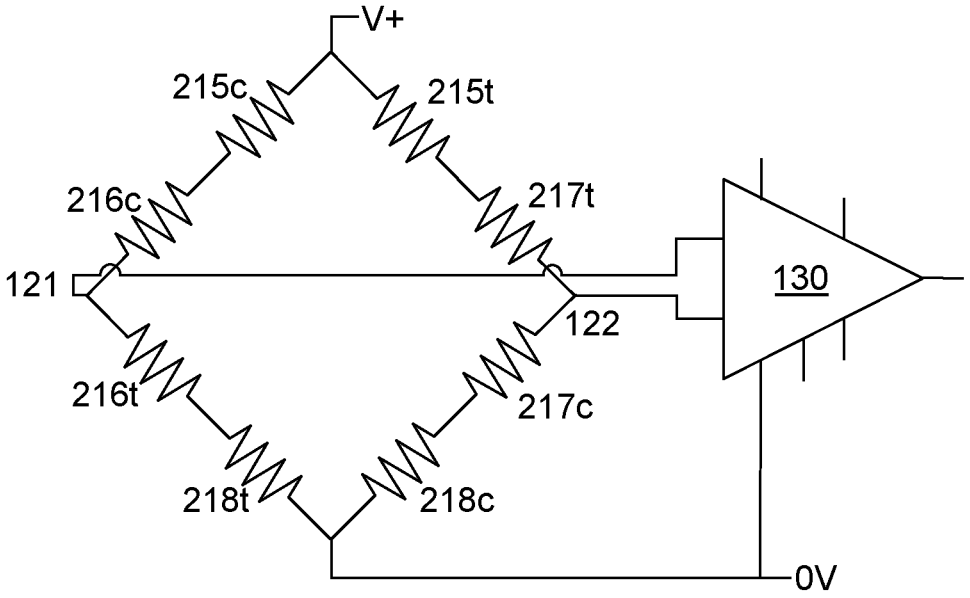

Although these strain gauges 211-218 are attached to surfaces which extend radially rather than circumferentially relative to the cutter axis, they are connected in Wheatstone bridge circuits which are similar to circuits described above. The chevron shear gauges 211 and 213 on two of the connecting sections 206 are connected in a Wheatstone bridge as shown in FIG. 31. This functions in the same way as the circuit shown in FIG. 21. The shear gauges 212 and 214 on the other two connecting sections 208 are connected in a similar circuit. The Poisson gauges 215-218 are connected in the circuit shown in FIG. 32 which functions in the same way as the circuit shown in FIG. 19.

Figure 33:
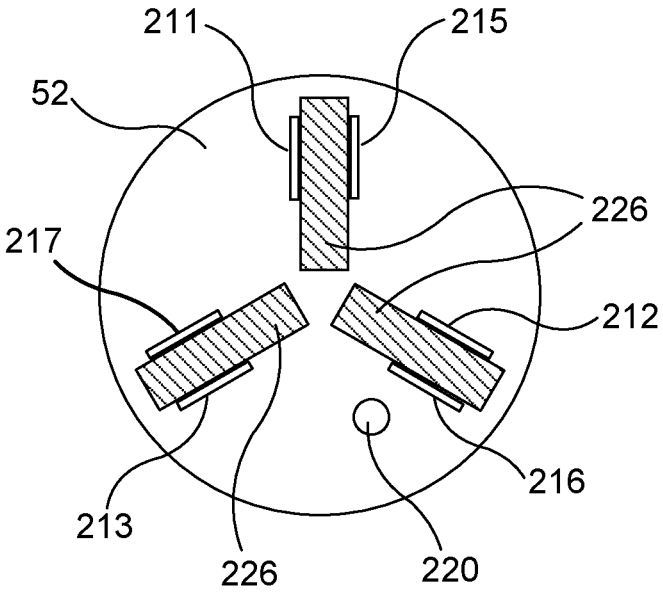
FIG. 33 is a cross-sectional view analogous to the view shown in FIG. 30, showing another embodiment of a cutter.
Figure 34:
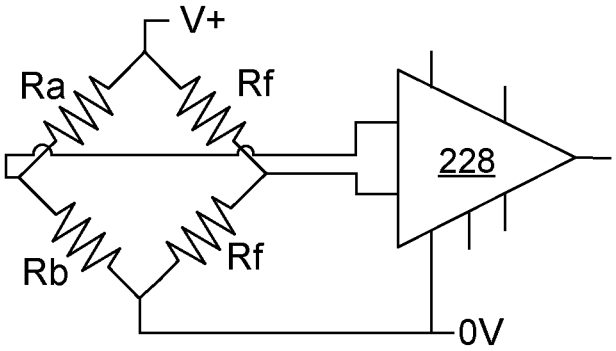
FIG. 34 is an example circuit diagram for a strain gauge used in the embodiment of FIG. 33, according to an embodiment of the present disclosure.

FIG. 33 shows a cutter which is similar to that of FIGS. 29 and 30, except that there are three connecting sections 226 instead of the four connecting sections 206, 208. These connecting sections 226 carry chevron shear gauges 211, 212 and 213 and Poisson gauges 215, 216 and 217 of the types shown in FIGS. 5 and 4 respectively. The two parts of each chevron shear gauge are connected in a Wheatstone bridge circuit with two fixed resistors Rf as illustrated by FIG. 34 where resistances Ra and Rb denote the two mutually perpendicular gauges of a chevron gauge shown in FIG. 5 The two parts of each Poisson gauge are connected in a similar circuit. There are then six Wheatstone bridge circuits and six differential amplifiers 228 altogether.

Each Wheatstone bridge will exclude effects of temperature change in the same manner as described earlier. Chevron gauges in such a Wheatstone bridge will exclude strain which is wholly axial because this will exert equal effects on both the individual gauges of a chevron gauge.

Because the gauges are on three connecting portions 226 at different azimuthal positions around the cutter axis, the extent to which each one is stretched or shortened by shear force on the disc 88 of the cutter depends on the direction of the shear force. However, resolution of forces into axial load and shear force in perpendicular directions is not done by the strain gauges and Wheatstone bridge circuits. Instead the analogue outputs from the differential amplifiers 228 are digitised and recorded. The recorded signals are then processed computationally to separate the axial force from shear forces and to resolve the shear forces in two mutually perpendicular directions.

Figure 35:
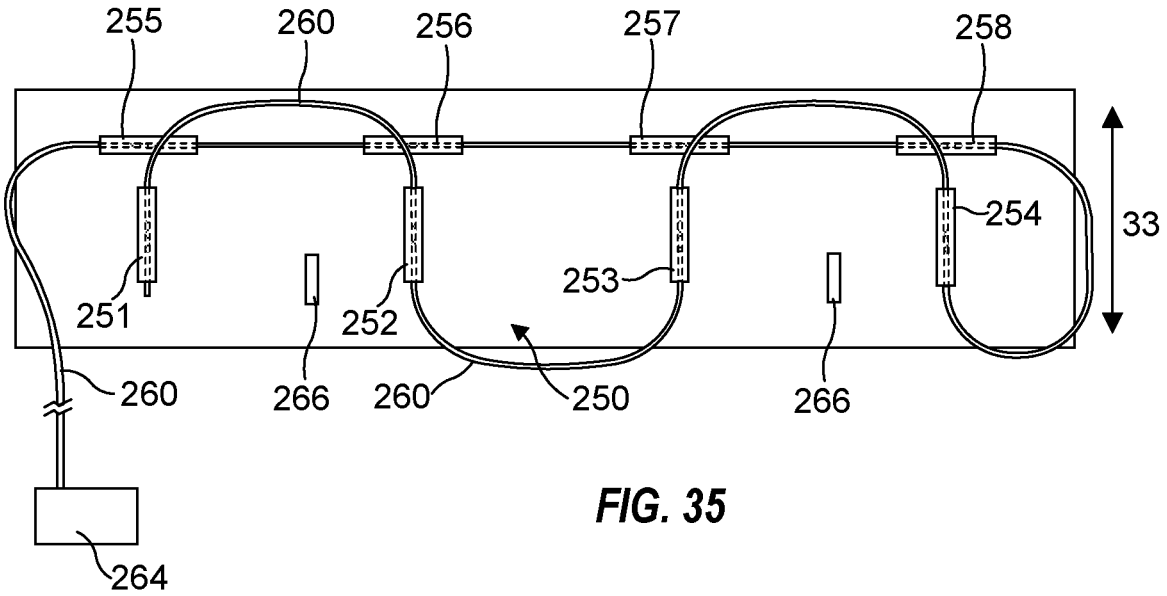
FIG. 35 is a top view of a group of fiber Bragg sensors on a carrier, according to an embodiment of the present disclosure.
Figure 36:
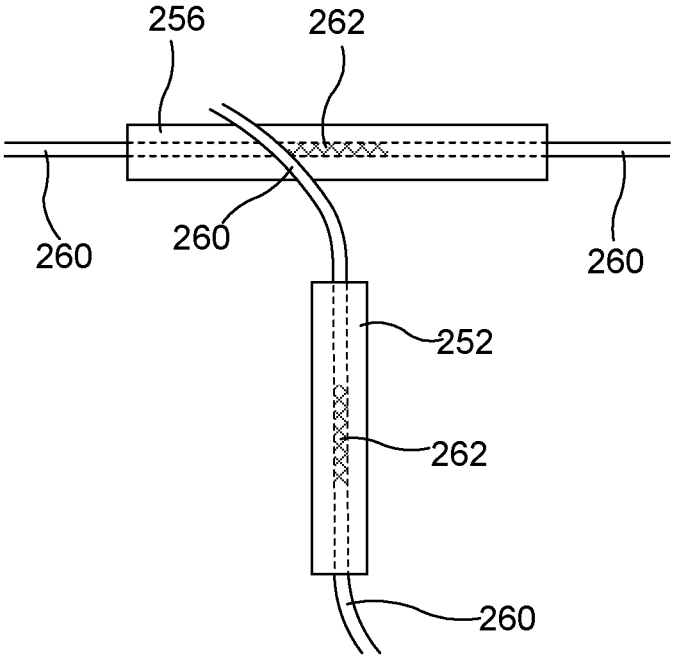
FIG. 36 is an enlarged top view of two fiber Bragg sensors that may be used on the carrier of FIG. 35.

FIGS. 35 and 36 show a different form of strain sensors which may be used instead of the electrical resistance strain gauges described above. These are optical sensors based on fiber Bragg gratings. A Bragg grating is formed in optical fiber by creating systematic variation of reflective index within a short length of the fiber. The grating selectively reflects light of a specific wavelength which is dependent on the spacing of the grating. Strain of the fiber alters the spacing of the grating and so alters the wavelength at which reflection by the grating is at a maximum because there is maximum constructive interference.

Patent literature on the creation of Bragg gratings by means of ultraviolet light to irradiate a photosensitive optical fiber includes U.S. Pat. Nos. 5,956,442 and 5,309,260 along with documents referred to therein. Strain sensors based on Bragg grating in optical fiber are available from a number of suppliers including HBM and National Instruments.

FIG. 35 shows a carrier 250 to which are adhered eight individual sensors 251-258 formed in an optical fiber 260. Two of these sensors 252 and 256 are shown to a larger scale in FIG. 35. Each sensor contains a Bragg grating, which is a short length of fiber 262 with systematic refractive index variations. For use, the optical fiber 260 is connected to an interrogating device indicated schematically at 264 which directs light of varying wavelengths along the common fiber 260, receives the reflection and determines the wavelength at which reflectance is greatest. When a portion of the fiber 260 containing a grating is compressed or stretched, there is a change in the wavelength at which reflectance is greatest. The observed change in wavelength is proportional to the strain and in turn proportional to the force causing the strain. The gratings of the eight sensors 251-258 are all made with different spacings so that they reflect different wavelengths. Consequently all can be interrogated by the same device 264 transmitting and receiving light along the common optical fiber 260.

The carrier 250 is adhered to the inside of the cylindrical connecting section 84 of a cutter of the type shown by FIGS. 10 to 15 such that the four sensors 251-254 extend in the axial direction while the sensors 255-258 extend circumferentially. The optical fiber 260 is led out through the passage 84. The sensors 251-254 are formed in parts of the fiber which extend axially and these observe axial force on the outer end portion 80 of the cutter, but are not affected by shear forces. The sensors 255-259 are not affected by axial forces but are affected by shear forces. The sensors 255 and 257 are diametrically opposite each other and observe components of shear force parallel to this diameter. The sensors 256 and 258 are also diametrically opposite each other on a diameter which is perpendicular to the diameter joining sensors 255 and 257. Thus sensors 256 and 258 observe components of shear force orthogonal to those affecting sensors 255 and 257.

The output from the interrogating device 264 may be in digital form and may be processed by computer to give measurements of strain of the connecting section 84 and hence of force on the cutter's outer portion 22. The Bragg gratings are sensitive to temperature as well as strain. Consequently thermistors or other temperature sensors are attached to the carrier 250 as indicated at 266 and processing the outputs from the interrogating device 264 includes correction for the effects of temperature.

Another technology which may possibly be used for strain sensors inside a connecting section 84 is piezoresistive sensors, which are also known as "semiconductor strain gauges". Such sensors have an electrically conductive path which includes a semiconducting material. The electrical resistance of this material is affected by strain of the material causing a change of interatomic-spacing within the semiconductor. The change in resistance in response to strain is greater than with electrical resistance sensors. Suppliers of such gauges include Micron Instruments, Simi Valley, California, USA and Kulite Semiconductor Products Inc., New Jersey, USA.

Figure 37:
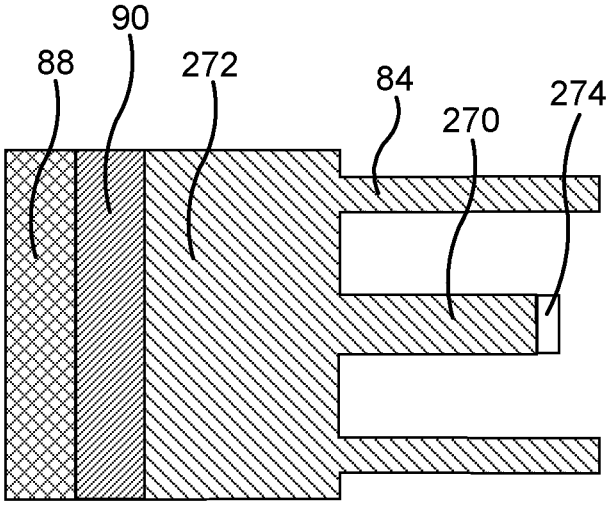
FIGS. 37 and 38 are longitudinal cross-sectional views of two parts of a cutter that incorporates a capacitive sensor, according to an embodiment of the present disclosure.
Figure 38:
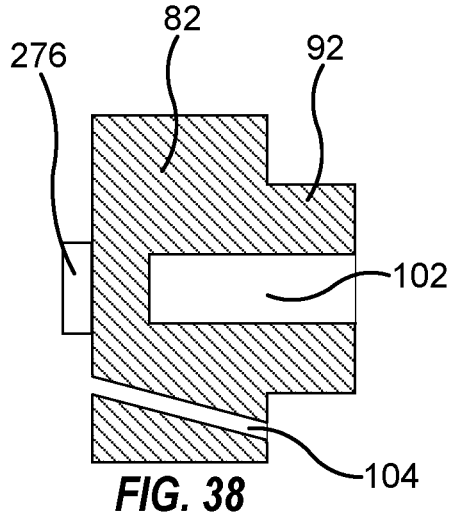
Figure 39:
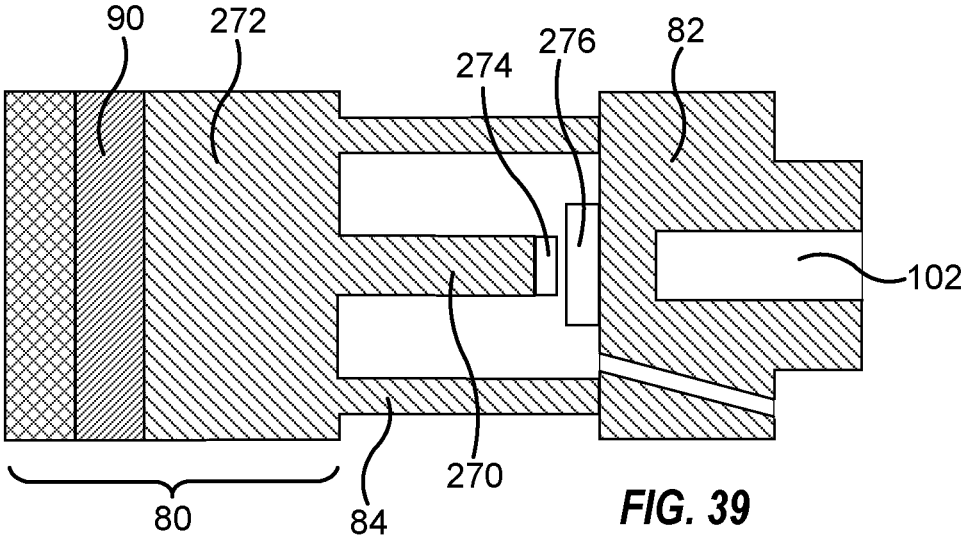
FIG. 39 is a longitudinal cross-sectional view of the cutter of FIGS. 37 and 38, after joining the two parts.
Figure 40:
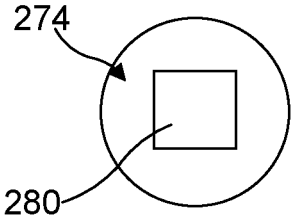
FIGS. 40 and 41 are face views of the two parts of the capacitive sensor shown in FIGS. 37 and 38.
Figure 41:
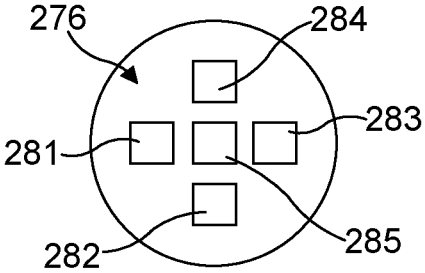

FIGS. 37-41 show a cutter which has the same shape and dimensions as the cutter of FIGS. 7 to 15, but which utilises a capacitive position sensor to observe displacement of the outer end portion 80 relative to the inner end portion 82. FIG. 37 is analogous to FIG. 12. A solid cylinder attached to the disc shaped body 90 of a PDC cutter has been machined to form a cylindrical connecting portion 84 and a central pillar 270 both extending from a solid cylindrical portion 272 attached to the body 90 of the PDC cutter. The part shown in FIG. 38 is largely the same as that in FIG. 14. It consists of the inner end portion 82 and square end portion 92 but the bore 82 does not extend fully through the inner end portion 82.

A capacitive sensor is formed by a disc 274 of electrically insulating material adhered to the pillar 270 and a larger disc 276 of insulating material adhered to the inner end portion 82. The facing surfaces of discs 274, 276 have electrodes set into them. As shown by FIG. 70, the inset electrode in part 274 is a square electrically conductive plate 280. FIG. 71 shows five square electrically conductive plates 281-285 inset in the disc 276.

Axial force on the outer end portion 80 pushes the plate 210 closer to the conductive plates on the part 276 and can be measured as an increase in capacitance of the capacitor formed by the plates 280 and 285. Shear forces on the outer end portion 80 causes distortion of the cutter such that the end of pillar 270 shifts slightly away from the axis of the inner end portion and can be measured as a change in capacitances between the plate 280 and two or more of the plates 281-284. These capacitance measurements are made by an electronics package which repeatedly measures capacitances with alternating potentials applied to the plate 280 and each of the plates 281-285 in turn. Because the plates 281 and 283 lie on a diameter and the plates 282 and 284 lie on a perpendicular diameter, shear forces can be resolved into components along these diameters.

Another possibility, which is constructionally similar to the arrangement in FIGS. 37-41 omits the part 274 from the end of pillar 270 and provides inductive sensors at the positions of the plates 280-285. Forces on the outer end portion causing distortion of the connecting section 84 cause changes in the position of the pillar 270 and hence changes in inductive coupling between the inductive sensors and the pillar 270. These changes are observed and measured as changes in the outputs from the inductive sensors at positions 280-285.

It will be appreciated that the embodiments and examples described in detail above can be modified and varied within the scope of the concepts which they exemplify. Proportions may be varied and may not be as shown in the drawings which are schematic and intended to explain layout and function of the embodiments. Features referred to above or shown in individual embodiments above may be used together in any combination as well as those which have been shown and described specifically. More particularly, where features were mentioned above in combinations, details of a feature used in one combination may be used in another combination where the same feature is mentioned. Accordingly, all such modifications are intended to be included within the scope of this disclosure as defined in the following claims.

The invention claimed is:

1. A rotary cutting tool for creating or enlarging an underground conduit comprising:

a tool body defining a cavity having an open leading end;

a cutter fitted into the cavity and attached to the tool body with an axis of the cutter extending into the cavity from the open leading end, the cutter having:

a cutter body with an outer end portion exposed at the open leading end of the cavity; and at least one connecting section connecting the cutter to the tool body, a cross-section of the at least one connecting section being smaller than a cross-section of the outer end portion, the at least one connecting section further having greater compliance than the outer end portion, wherein the outer end portion and the at least one connecting section are sufficiently movable within the cavity that movement of the outer end portion transverse to the cavity causes strain of the at least one connecting section but the cavity surrounds at least part of the outer end portion sufficiently closely to limit such transverse movement and limit deformation of the at least one connecting section; at least three sensors attached to the at least one connecting section at different azimuthal positions around the axis and arranged to measure force on the outer end portion acting in a plurality of directions transverse to the axis, which force causes strain of the at least one connecting section; and at least three sensors attached to the at least one connecting section at different azimuthal positions around the axis and arranged to measure force on the outer end portion in the axial direction, which force causes strain of the at least one connecting section.

2. The rotary tool of claim 1, the at least one cutter body including an inner end portion in the cavity and fixed to the tool body, wherein the at least one connecting section extends between and is rigidly connected to the inner and outer end portions, and the at least one connecting section has a cross-section that is smaller than cross-sections of both the inner and outer end portions, and has greater compliance than both the inner and outer end portions.

3. The rotary tool of claim 2, wherein the outer end portion of the cutter body is cylindrical and at least part of the inner end portion is other than cylindrical and engages a mating part of the cavity that has a shape restricting rotation of the inner end portion.

4. The rotary tool of claim 2, the at least one connecting section including a plurality of connecting sections extending between and rigidly connected to the inner and outer end portions.

5. The rotary tool of claim 2, the at least one connecting section including a single connecting section, which single connecting section defines a cylinder extending between and rigidly connected to the inner and outer end portions.

6. The rotary tool of claim 2, the at least one connecting section including a single connecting section defining a cylinder extending between and rigidly connected to the inner and outer end portions, and the sensors are a plurality of strain sensors attached to an inside wall of the cylinder.

7. The rotary tool of claim 1, wherein the cavity surrounds at least part of the outer end portion of the at least one cutter sufficiently closely to prevent deformation of the at least one connecting section beyond elastic strain.

8. The rotary tool of claim 1, wherein the at least one connecting section and the surrounding cavity of the tool body are dimensioned so that spacing between the at least one connecting section and the wall of the cavity is greater than spacing between the outer end portion and the wall of the cavity.

9. The rotary tool of claim 1, wherein the outer end portion has a cutting face that is exposed at the open leading end of the cavity and which has a Knoop hardness of at least 1600.

10. The rotary tool of claim 1, wherein the outer end portion is integral with the at least one connecting section.

11. The rotary tool of claim 1, wherein the sensors include at least one capacitive or inductive sensor that senses a position of the outer end portion relative to the tool body.

12. The rotary tool of claim 1, wherein the sensors are one or more of an electrical resistance strain gauge, an optical fiber Bragg grating sensor, or a piezoresistive strain sensor.

13. The rotary tool of claim 1, wherein the tool body is a drill bit body.

14. The rotary tool of claim 1, wherein the tool body is a reamer or reamer block body.

15. The rotary tool of claim 1 wherein:

the at least three sensors arranged to measure force in a plurality of directions transverse to the axis are chevron gauges connected in a Wheatstone bridge sensitive to shear force on the cutter and insensitive to axial loading and temperature changes of the cutter, each of the chevron gauges including a first gauge with a conductive path at 45° to an axis of the cutter and a second gauge with a conductive path orthogonal to that of the corresponding first gauge.

16. The rotary tool of claim 15 wherein:

the at least three sensors arranged to measure force in the axial direction are Poisson gauges which are not connected to any of the chevron gauges, each of the Poisson gauges including a first gauge with a conductive path parallel to the axis and a second gauge perpendicular to the axis.

17. The rotary tool of claim 1 wherein:

the sensors arranged to measure force in a plurality of directions transverse to the axis comprise two sensors at opposite ends of a notional diameter perpendicular to the axial direction and a further two sensors at opposite ends of another notional diameter perpendicular to both the axis and the first notional diameter; and the sensors arranged to measure force in the axial direction also comprise two sensors at opposite ends of a notional diameter perpendicular to the axial direction and a further two sensors at opposite ends of another notional diameter perpendicular to both the axis and the first notional diameter.

18. The rotary tool of claim 1 wherein the sensors are optical fiber Bragg grating sensors.

19. A method of observing forces on a cutter of a rotary cutting tool comprising:

positioning a rotary tool of claim 1 in a wellbore; and observing or recording data from the at least one sensor while operating the tool within a conduit.

20. A downhole cutting tool, comprising:

a tool body defining at least one pocket having an open leading end;

a cutter in the pocket and attached to the tool body, the cutter having:

a cutter body with an outer end portion exposed at the open leading end of the pocket, the pocket dimensions permitting at least some transverse movement of the outer end portion;

a connecting section connecting the cutter to the tool body, the connecting section having a different cross-sectional area when compared to a cross-sectional area of the outer end portion and exhibiting greater compliance than the outer end portion, the pocket surrounding the connecting section and providing higher resistance to transverse movement of the connecting section as compared to the outer end portion; and a plurality of strain gauges coupled to a carrier wrapped around an inner surface of the connecting section, the plurality of strain gauges including:

at least four chevron gauges connected in a Wheatstone bridge sensitive to shear force on the cutter and insensitive to axial loading and temperature changes of the cutter, each of the at least four chevron gauges including a first gauge with a conductive path at 45° to an axis of the cutter and a second gauge with a conductive path orthogonal to that of the corresponding first gauge; and at least four Poisson gauges connected in a Wheatstone bridge sensitive to axial force on the cutter and insensitive to shear loading and temperature changes of the cutter, the at least four Poisson gauges not being connected to any of the at least four chevron gauges, each of the at least four Poisson gauges including a first gauge with a conductive path parallel to the axis of the cutter and a second gauge perpendicular to the axis of the cutter.

* * * * *